US011397394B2

(12) United States Patent
Sako et al.

(10) Patent No.: US 11,397,394 B2
(45) Date of Patent: Jul. 26, 2022

(54) IMAGE FORMING APPARATUS

(71) Applicant: CANON KABUSHIKI KAISHA, Tokyo (JP)

(72) Inventors: Masato Sako, Mishima (JP); Hirohiko Aiba, Suntou-gun (JP); Tomoki Fujikawa, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/204,222

(22) Filed: Mar. 17, 2021

(65) Prior Publication Data

US 2021/0200129 A1 Jul. 1, 2021

Related U.S. Application Data

(63) Continuation of application No. 16/943,193, filed on Jul. 30, 2020, now Pat. No. 10,983,465.

(30) Foreign Application Priority Data

Jul. 30, 2019 (JP) ..... JP2019-139601

(51) Int. Cl.
*G03G 15/20* (2006.01)

(52) U.S. Cl.
CPC ..... *G03G 15/2053* (2013.01); *G03G 15/2039* (2013.01); *G03G 15/2064* (2013.01); *G03G 2215/2038* (2013.01)

(58) Field of Classification Search
CPC ..... G03G 15/2039; G03G 15/2053; G03G 15/2064; G03G 2215/2038
See application file for complete search history.

(56) References Cited

U.S. PATENT DOCUMENTS

| | | | |
|---|---|---|---|
| 8,346,106 | B2 | 1/2013 | Takenaka et al. |
| 10,838,328 | B2 | 11/2020 | Uchiyama |
| 2018/0004134 | A1 | 1/2018 | Nomura et al. |

FOREIGN PATENT DOCUMENTS

| | | | |
|---|---|---|---|
| JP | 2006030823 | A | 2/2006 |
| JP | 2010038926 | A | 2/2010 |
| JP | 2014059508 | A | 4/2014 |
| JP | 6180555 | B2 | 8/2017 |
| JP | 2017223903 | A | 12/2017 |
| JP | 2018004940 | A | 1/2018 |

*Primary Examiner* — Gregory H Curran
(74) *Attorney, Agent, or Firm* — Venable LLP

(57) ABSTRACT

An image forming apparatus, including: an image forming portion that forms an image on a recording material based on image data; a fixing portion that includes a heater having a plurality of heat generating members arranged in a direction perpendicular to a conveying direction of a recording material, and that fixes the image to the recording material using heat of the heater; a storage portion that stores history information on the recording material when image forming operation is performed in which the image forming portion forms the image and the fixing portion fixes the image, a control portion that sets power to be supplied to the heat generating members based on the history information before a type of the recording material on which the image is formed or content of the image data of the image to be formed on the recording material is determined.

2 Claims, 26 Drawing Sheets

IMAGE FORMING APPARATUS

CROSS-REFERENCE TO RELATED APPLICATIONS

The present application is a Continuation of U.S. patent application Ser. No. 16/943,193, filed on Jul. 30, 2020, which claims the benefit of Japanese Patent Application No. 2019-139601, filed on Jul. 30, 2019, which are both hereby incorporated by reference herein in their entireties.

BACKGROUND OF THE INVENTION

Field of the Invention

The present invention relates to an image forming apparatus, such as a copier and a printer, using an electrophotographic system or an electrostatic recording system.

Description of the Related Art

In some cases, an image forming apparatus, which uses an electrophotographic system, an electrostatic recording system or the like, is equipped with an image heating apparatus which includes a fixing film, a heater that contacts the inner surface of the fixing film, and a roller that forms a fixing nip N with the heater via the fixing film. For such an image forming apparatus, it is desirable to decrease the first print out time (FPOT), which is the time from receiving a print instruction to discharging the recording material, on which the toner image is formed, to outside the apparatus. An available method of decreasing FPOT is a method of starting pre-heating of the image heating apparatus at the same time as the start of image data processing, and executing the respective processing and operation in parallel (pre-heating sequence). In concrete terms, a video controller issues a pre-command (instruction to prepare image formation) to an engine controller. The pre-command is issued before the video controller sends a print start command (instruction to start image formation) with print reservation information, such as a print mode (image forming condition that is set in accordance with the paper type (e.g. plain paper, thick paper)) and a recording material size, to the engine controller. When the pre-command is received, the engine controller starts the pre-heating sequence.

A control target temperature (hereafter "target temperature"), to heat the image heating apparatus during the image forming operation, differs depending on the print mode, therefore it is preferable that the target temperature in the pre-heating sequence is also changed depending on the print mode. As a method of optimizing the target temperature in the pre-heating sequence, Japanese Patent Application Publication No. 2017-223903 discloses a method of starting pre-heating of the image heating apparatus at a target temperature and speed, which were set in association with the stacking unit of the recording material, in the pre-heating sequence.

In the case of the image forming apparatus equipped with this image heating apparatus, a temperature rise in a non-sheet-passing portion is generated if continuous image forming (continuous printing) is performed using recording materials of which a size in the direction perpendicular to the conveying direction of the recording material (longer direction) is smaller than the maximum sheet passing width (small size paper). In other words, a temperature of each part of the region where the recording material does not pass in the longer direction of the fixing nip N (non-sheet-passing portion) rises more than necessary.

One method of suppressing the temperature rise in the non-sheet-passing portion, which was proposed, is an apparatus according to Japanese Patent Application Publication No. 2014-59508, where heating resistors on the heater are divided into a plurality of groups (heat generating blocks) in the longer direction of the heater, and the heating distribution of the heater is switched in accordance with the size of the recording material.

In this apparatus, the temperature in each heat generating block where a recording material passes (sheet passing block) is controlled to a temperature value that is required to fix the toner image. The temperature in each heat generating block where a recording material does not pass (non-sheet passing block), on the other hand, is controlled at a low control temperature or at heating OFF for power saving, and is controlled at a lower limit temperature that is required for rotating the film.

In some cases, power consumption required for heating a toner image is reduced by changing the target temperature of the image heating apparatus in accordance with the toner amount on the recording material. In the case of using this method, if recording materials, of which toner amounts are different from each other, are printed continuously, the target temperature may be drastically changed at each printing, which may destabilize the temperature control.

A method of stabilizing the temperature control is disclosed in Japanese Patent No. 6180555. According to Japanese Patent No. 6180555, a video controller calculates image information (e.g. later mentioned Maxink) based on the image data received from an external apparatus. Then a tentative target temperature is set in accordance with image information on a plurality of pages, such that in the case where the toner amount of succeeding sheet is higher than the toner amount of preceding sheet, the target temperature of the preceding sheet is higher than the tentative target temperature in accordance with the toner amount of the preceding sheet, and is lower than the tentative target temperature in accordance with the toner amount of the succeeding sheet. Thereby a drastic change of target temperature is suppressed, and the temperature control is stabilized.

SUMMARY OF THE INVENTION

However, in the stage of receiving the pre-command, the print reserve information and image information (e.g. size of recording material on which an image is formed) may not be sent from the video controller to the engine controller, as mentioned above. Therefore, in the pre-heating sequence, each heating region must be heated to the target temperature in the print mode corresponding to the recording material stacking unit, even if a small size paper or a recording material of which image width is small is printed.

Further, when small size paper is printed, a new print reservation may be added to subsequent printing, and an image may be formed on a recording material of which width is larger than this small size paper (large size paper). In order to maintain high printability even in such a case, it is necessary to maintain the non-sheet passing block at a high heating amount, even during small size paper printing.

Furthermore, when the image of the succeeding sheet has not yet been developed and image information is insufficient, the tentative target temperature of the succeeding sheet must be set to a temperature corresponding to the maximum value of the toner amount, preparing for the case where the toner amount of the succeeding sheet is at the maximum. This means that the target temperature of the preceding sheet must be set higher than the case where image information of the succeeding sheet is determined.

In order to achieve satisfactory FPOT, productivity and image quality for all user methods, a high heating amount must be maintained, as mentioned above, in the case where paper size information and image information of the succeeding sheet are insufficient, even if the non-sheet passing block or a region on the recording material where a toner amount is low are heated.

Depending on the intended use by the user, in some cases power consumption can be reduced. For example, when the user regularly performs printing on a small size paper as routine work (e.g. printing specific vouchers and reports), or when the user regularly performs printing according to a specific layout (e.g. business documents), power can be reduced.

However, it is still possible that the user will perform printing other than regular work, even if not frequent, hence temperature control to maintain good image quality even in such a case is required.

An object of the present invention is to provide a technique to reduce power consumption using power control based on the operation history of the user, while maintaining good image quality.

In order to achieve the object described above, an image forming apparatus, including:

an image forming portion that forms an image on a recording material based on image data;

a fixing portion that includes a heater having a plurality of heat generating members arranged in a direction perpendicular to a conveying direction of a recording material, and that heats the image using heat of the heater so as to fix the image to the recording material;

a control portion controls the image forming portion and the fixing portion; and a storage portion that stores history information on the recording material when image forming operation is performed in which the image forming portion forms the image and the fixing portion fixes the image, wherein the control portion sets power to be supplied to the heat generating members based on the history information before a type of the recording material on which the image is formed or content of the image data of the image to be formed on the recording material is determined.

According to the present invention, power consumption can be reduced using power control based on the operation history of the user, while maintaining good image quality. Further features of the present invention will become apparent from the following description of exemplary embodiments with reference to the attached drawings.

DESCRIPTION OF THE EMBODIMENTS

Embodiments of the present invention will be described with reference to the drawings. Dimensions, materials, shapes and relative positions of components described below in the embodiments should be appropriately changed depending on the configurations and various conditions of the apparatuses to which the invention is applied, and are therefore not intended to limit the scope of the invention to the following embodiments.

Embodiment 1

As Embodiment 1 of the present invention, an example of reducing power consumption for a user who regularly performs printing on small size paper, by changing the heating amount of a non-sheet passing block in the pre-heating sequence based on the history of print reserve information, will be described.

Configuration of Image Forming Apparatus

Figure 1:
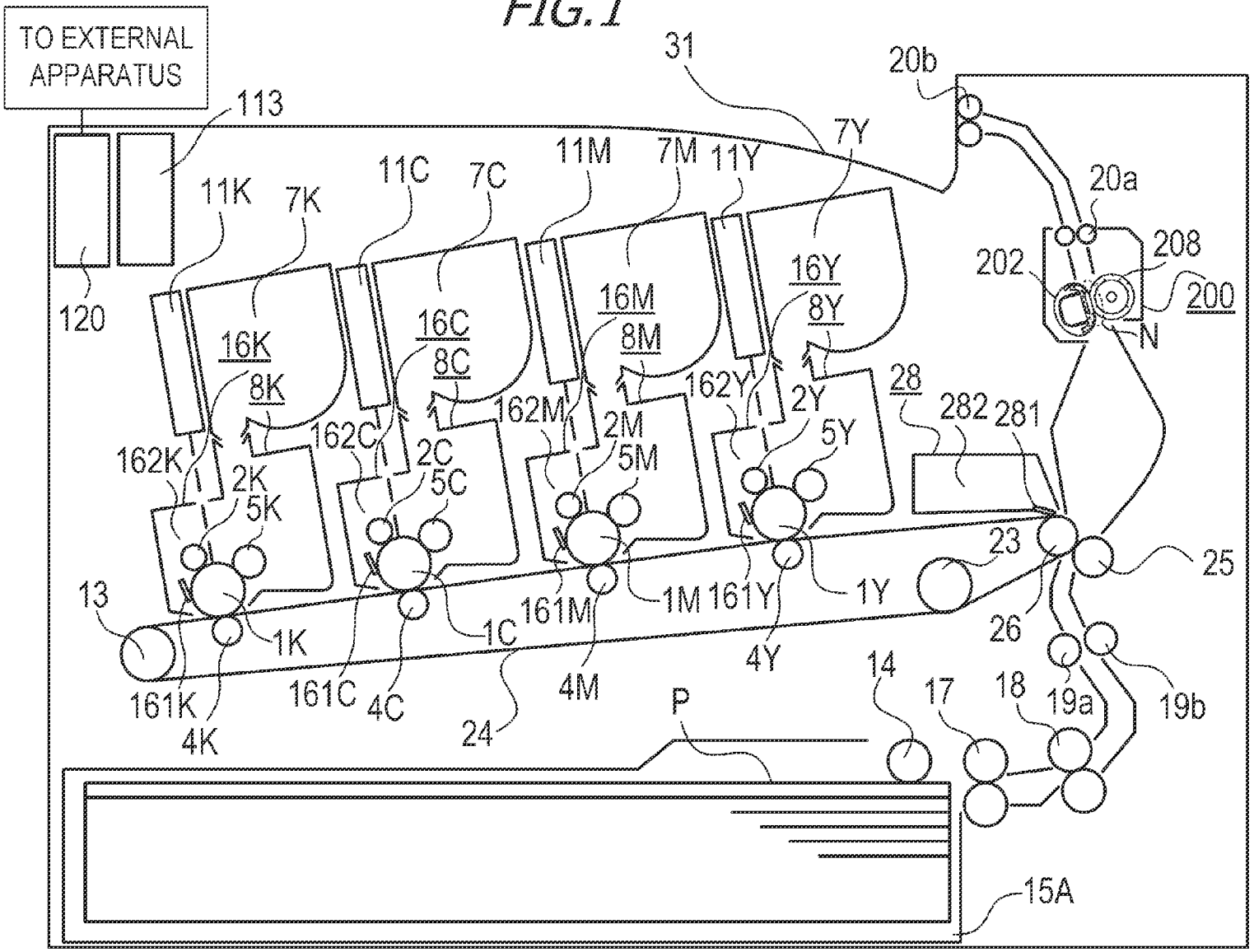
FIG. 1 is a diagram depicting a configuration example of an image forming apparatus.

FIG. 1 is a schematic cross-sectional view of an image forming apparatus according to Embodiment 1. In Embodiment 1, a color image forming apparatus using an intermediate transfer belt is used as an example of the image forming apparatus. The character Y, M, C or K appended to the end of the reference sign indicates the toner color, and is omitted in a description concerning issues common to all four colors.

The image forming apparatus of Embodiment 1 is a four-drum full color 600 dpi resolution printer equipped with an automatic double-sided print mechanism. As a toner image forming unit (image forming portion), the image forming apparatus includes: a photosensitive drum 1 (image bearing member); a charging roller 2 (primary charging unit); an exposure scanner unit 11; a developing device 8 (developing unit); a toner container 7 (toner replenishing unit); and a drum cleaner 16. Further, as a toner image forming unit, the image forming apparatus includes: an intermediate transfer belt 24 (rotating member); a secondary transfer roller 25; a driver roller 26 which functions as a counter-roller of the secondary transfer roller 25 while driving the intermediate transfer belt 24; a stretching roller 13; an auxiliary roller 23; and a primary transfer roller 4. Furthermore, the image forming apparatus includes a fixing apparatus (image heating apparatus) 200 as a fixing portion (image heating portion) that heats and fixes an unfixed toner image formed on a recording material. An engine controller 113 is connected with a video controller 120, and controls each of the above mentioned units of the image forming apparatus, responding to instructions from the video controller 120.

The photosensitive drum 1 is constructed by coating an organic photoconductive layer on the outer periphery of an aluminum cylinder, and is rotated by driving force transferred from a driving motor (not illustrated). The driving motor rotates the photosensitive drum 1 clockwise in accordance with the image forming operation.

When a print instruction is received from an external apparatus, the video controller 120 sequentially sends an image forming preparation instruction (hereafter "pre-command") and an imaging forming start instruction (hereafter "print start command") to the engine controller 113. When the instructions are received, the engine controller 113 sequentially instructs a pre-heating sequence, a pre-rotation sequence and a print sequence to each unit.

When the pre-command is sent from the video controller 120, the engine controller 113 instructs the pre-heating sequence. Thereby heating operation is started in a fixing apparatus 200.

When the print start command is sent from the video controller 120, the engine controller 113 instructs the pre-rotation sequence. In the pre-rotation sequence, the pre-rotation operation (e.g. preparation operation at each component of the apparatus) is executed prior to the print sequence. In other words, driving of the exposure scanner unit 11 is started, and the recording material P is fed from the paper feeding cassette 15A into the image forming apparatus by a pickup roller 14 and paper feeding rollers 17 and 18. Then the recording material P is held by roller type synchronizing rotating members, that is, a conveying (resist) roller 19*a* and a conveying (resist) counter-roller 19*b*, so as to synchronize the later mentioned image forming operation and conveying the recording material P, and stops and stands by in this state.

When the engine controller 113 instructs the print sequence thereafter, the exposure scanner unit 11 forms an electrostatic latent image in accordance with the received image data, on the surface of the photosensitive drum 1 which is charged to a predetermined potential by the charging roller 2.

The developing device 8 is a unit to make the electrostatic latent image visible, and performs development for each station for each color of YMCK. In each developing device 8, a developing roller 5 is disposed, to which developing bias is applied to make the electrostatic latent image visible. The electrostatic latent image formed on the surface of each photosensitive drum 1 like this is developed by the developing device 8 as a single color toner image.

The intermediate transfer belt 24 is in contact with the photosensitive drum 1, and rotates counterclockwise when a color image is formed, so as to synchronize with the rotation of the photosensitive drum 1. Each developed single color toner image is sequentially transferred by the function of the primary transfer bias applied to the primary transfer roller 4, and becomes a multicolor toner image on the intermediate transfer belt 24.

Toner that is not transferred to the intermediate transfer belt 24 and remains on each photosensitive drum 1 is collected by a drum cleaner 16 which is disposed in contact with the photosensitive drum 1. The drum cleaner 16 of each color is constituted of a cleaner blade 161 and a toner collection container 162.

The multicolor toner image formed on the intermediate transfer belt 24 is formed by a secondary transfer nip, which is formed with the secondary transfer roller 25. At the same time, the recording material P, which is in a standby state of being held by the conveying roller pair 19*a* and 19*b*, is conveyed to the secondary transfer nip by the function of the conveying roller pair 19*a* and 19*b*, while synchronizing with the multicolor toner image on the intermediate transfer belt. The multicolor toner image is transferred in batch from the intermediate transfer belt 24 to the recording material P by the function of secondary transfer bias applied to the secondary transfer roller 25.

The fixing apparatus 200 is constituted of: a pressure roller 208 (pressure member) which includes an elastic layer and which rotates; and a fixing film 202 which press-contacts the pressure roller 208 and forms a fixing nip portion N. A recording material P holding a multicolor toner image is conveyed by the pressure roller 208, and is heated and pressed by the fixing nip portion N, whereby the toner is fixed to the surface of the recording material P.

After the toner image is fixed, the recording material P is discharged to a paper delivery tray 31 by discharging rollers 20*a* and 20*b*, and the image forming operation ends.

A belt cleaner 28 cleans toner remaining on the intermediate transfer belt 24 (transfer residual toner) using a cleaner blade 281, and the transfer residual toner collected here is stored in a cleaner container 282 as waste toner.

In the image forming apparatus in Embodiment 1, the maximum sheet passing width in a direction perpendicular to the conveying direction of the recording material P is 216 mm, and letter size (216 mm×279 mm) recording material can be printed.

Configuration of Image Heating Apparatus

Figure 2:
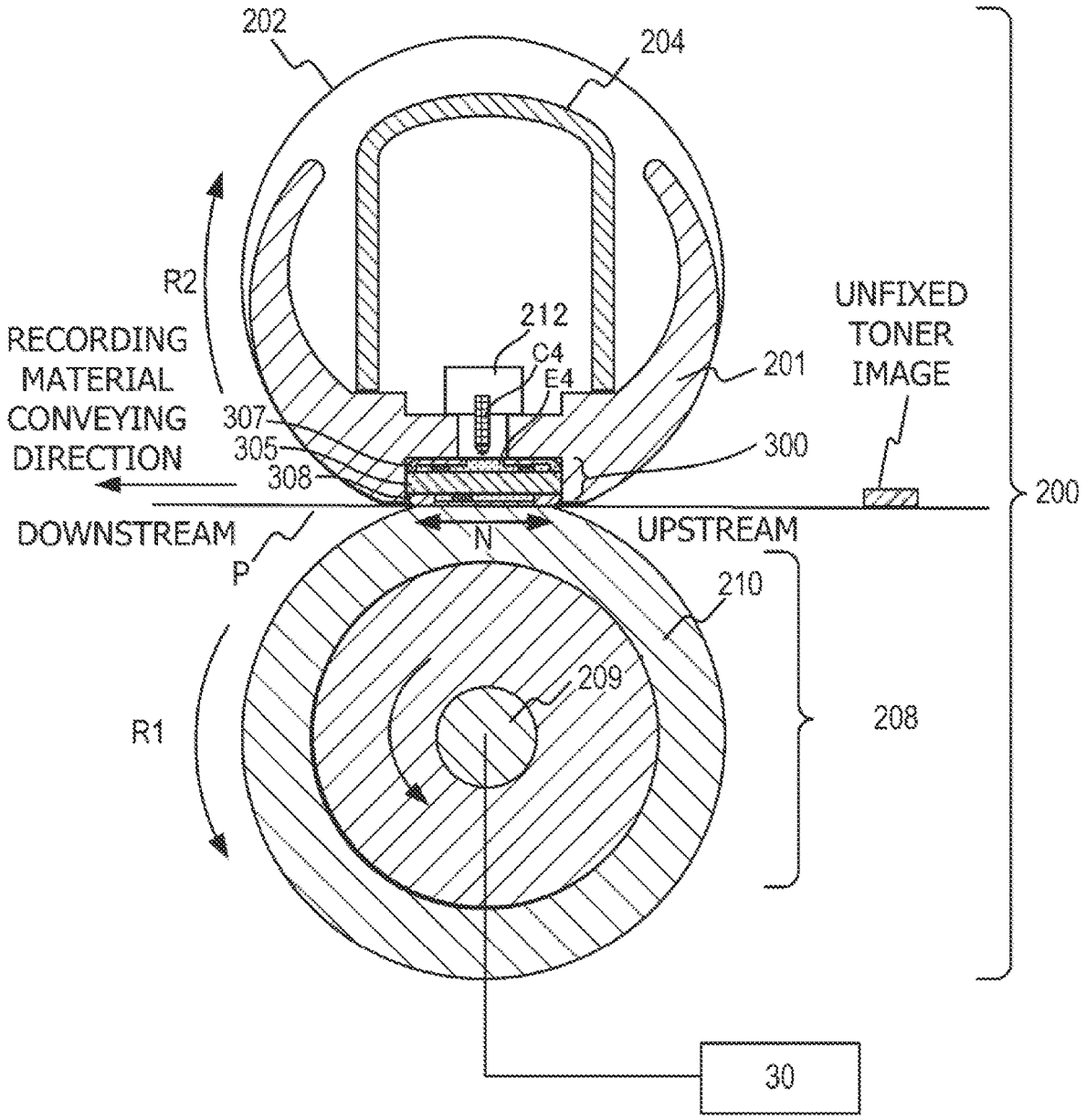
FIG. 2 is a schematic cross-sectional view of an image heating apparatus.

FIG. 2 is a schematic cross-sectional view of the fixing apparatus 200 according to Embodiment 1. The fixing apparatus 200 includes: the fixing film 202 (endless belt); a heater unit 400 which contacts an inner surface of the fixing film 202; and the pressure roller 208 which contacts an outer surface of the fixing film 202. The pressure roller 208 forms a fixing nip portion N with the heater unit 400 via the fixing film 202. The heater unit 400 includes a heater holding member 201, a metal stay 204 and the heater 300.

The fixing film 202 is a tubular multilayer heat resistant film, of which base layer may be a thin heat resistant resin (e.g. polyimide) or metal (e.g. stainless steel). On the surface of the fixing film 202, a release layer is formed to prevent attachment of toner and to ensure separation from the recording material P, by coating a heat resistant resin which excels in releasability, such as tetrafluoroethylene-perfluoro alkyl vinyl ether copolymer (PFA). Further, in the case of an apparatus to form color images, a heat resistant rubber (e.g. silicon rubber) may be formed between the base layer and the release layer to improve image quality.

The pressure roller 208 includes a core metal 209 formed of iron, aluminum or the like, and an elastic layer 210 formed of silicon rubber or the like.

The heater 300 includes: a ceramic substrate 305 on which heat generating members 302 are formed; a surface protective layer 308 which is disposed on the side of the fixing nip portion N; and a surface protective layer 307 which is disposed on the opposite side to the fixing nip N side. The heater 300 further includes a plurality of electrodes (electrode E4 is indicated here as a representative) on the opposite side to the fixing nip N side. A plurality of electric contacts (electric contact C4 is indicated here as a representative) which contact the electrodes are disposed in internal space of the fixing film 202, and power is supplied from each electric contact to each electrode. The heater 300 will be described in detail later.

A safety element 212 (e.g. thermo-switch, thermal fuse), which is activated by overheating of the heater 300 and shuts the power to be supplied to the heater 300 OFF, directly contacts the heater 300, or indirectly contacts the heater 300 via the heater holding member 201.

The heater 300 is held by the heater holding member 201 which is formed of a heat resistant resin, and heats the fixing film 202. The heater holding member 201 also has a guide function to guide the rotation of the fixing film 202.

A metal stay 204 receives pressing force (not illustrated) and energizes the heater holding member 201, which holds the heater 300, toward the pressure roller 208, so as to form the fixing nip portion N between the fixing film 202 and the pressure roller 208.

The pressure roller 208 receives power from the motor 30, and rotates in the arrow R1 direction. By the rotation of the pressure roller 208, the fixing film 202 is rotated in the arrow R2 direction. While holding and conveying the recording material P in the fixing nip portion N, heat of the fixing film 202 is transferred to the recording material P, whereby the unfixed toner image on the recording material P is fixed.

Configuration of Heater

Figure 3A:
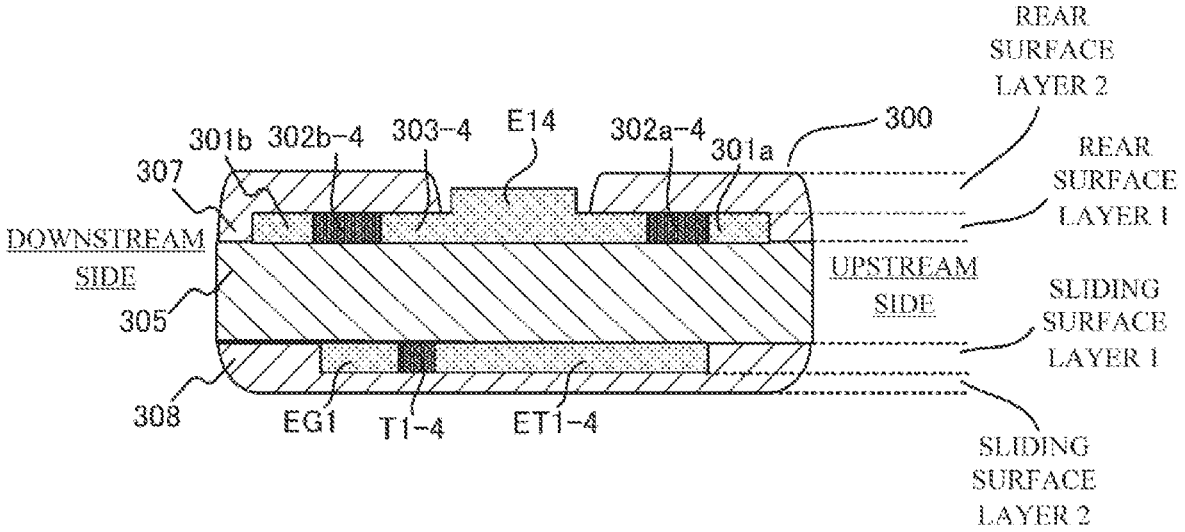
FIG. 3A and FIG. 3B are diagrams depicting a configuration of a heater.
Figure 3B:
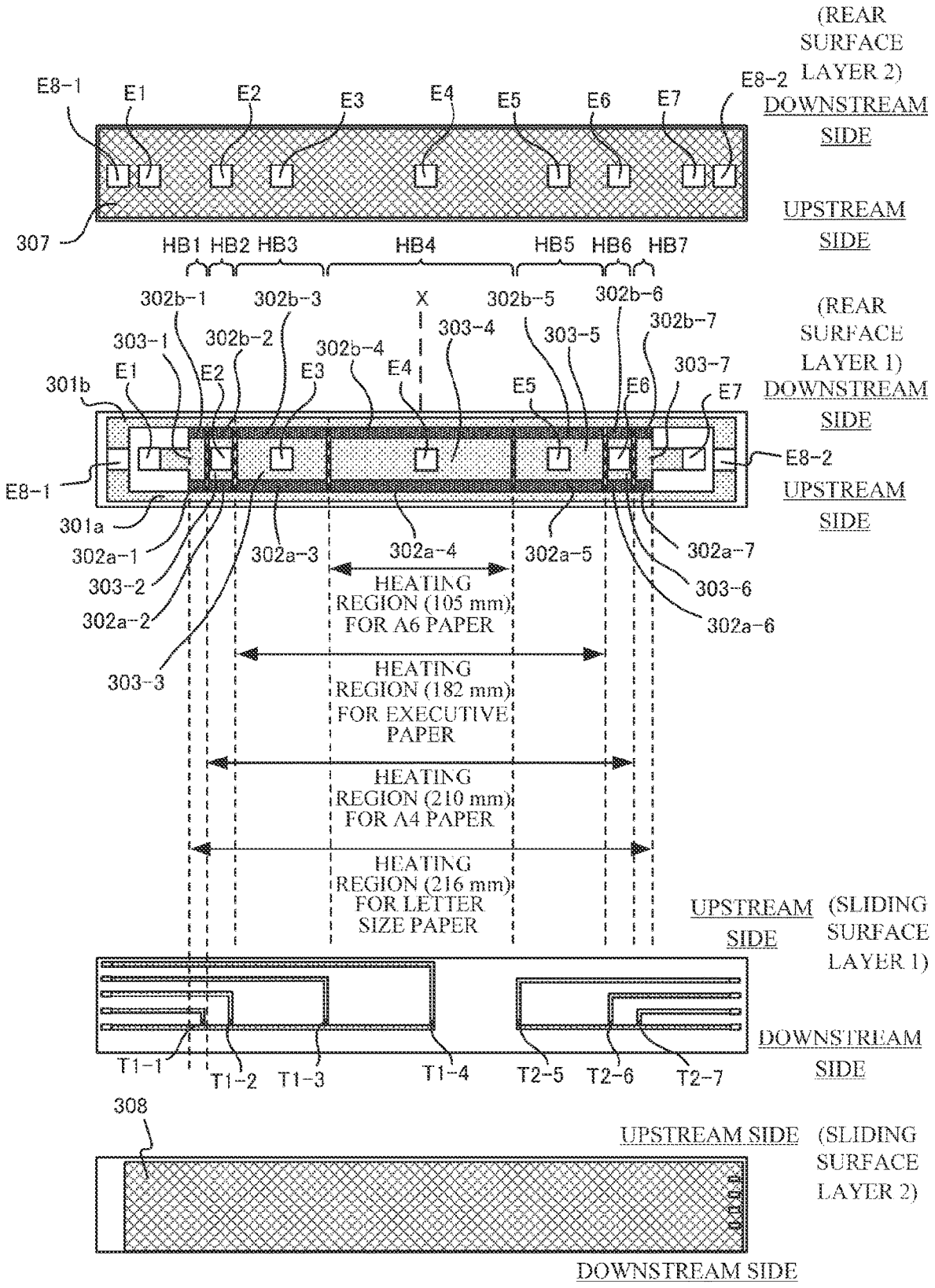

FIG. 3A and FIG. 3B are diagrams depicting the configuration of the heater 300 according to Embodiment 1.

FIG. 3A is a cross-sectional view around the conveyance reference position X indicated in FIG. 3B. The definition of the conveyance reference position X is a reference position to convey the recording material P. In Embodiment 1, the recording material P is conveyed such that the center position thereof passes through the conveyance reference position X.

The heater 300 includes first conductors 301 (301*a*, 301*b*) which are disposed on the substrate 305 on the rear surface layer side, along the longer direction (direction perpendicular to the conveying direction of the recording material). The heater 300 also includes second conductors 303 (303-4 is disposed near the conveyance reference position X), which are disposed on the substrate 305 in the longer direction, at positions which are different from the first conductors 301 in the conveying direction of the recording material. The first conductors 301 are divided into conductors 301*a* which are disposed on the upstream side in the conveying direction of the recording material P, and conductors 301*b* which are disposed on the downstream side thereof. Further, the heater 300 includes heat generating members 302, each of which is disposed between the first conductor 301 and the second conductor 303, and heats up by power that is supplied via these conductors.

In Embodiment 1, the heat generating members 302 are divided into heat generating members 302*a* (302*a*-4 is disposed near the conveyance reference position X) which are disposed on the upstream side in the conveying direction of the recording material P, and heat generating members 302*b* (302*b*-4 is disposed near the conveyance reference position X) which are disposed on the downstream side thereof.

On the rear surface layer 2 of the heater 300, the insulating surface protective layer 307, which covers the heat generating members 302, the first conductors 301 and the second conductors 303 (303-4 is disposed near the conveyance reference position X), is disposed so as to avoid electrode portions (E4 is disposed near the conveyance reference position X).

FIG. 3B is a plan view of each layer of the heater 300. On the rear surface layer 1 of the heater 300, a plurality of heat generating blocks (each heat generating block includes a set of the first conductor 301, the second conductor 303 and the heat generating member 302) are arranged in the longer direction of the heater 300. The heater 300 of Embodiment 1 includes a total of seven heat generating blocks, HB1 to HB7, in the longer direction. A heat generating region is from the left end of the heat generating block HB1 to the right end of the heat generating block HB7 in FIG. 3B, and the length thereof is 216 mm, which corresponds to the width of letter size paper. The length from the left end of the heat generating block HB2 to the right end of the heat generating block HB6 in FIG. 3B is 210 mm, which corresponds to the width of A4 size paper. The length from the left end of the heat generating block HB3 to the right end of the heat generating block HB5 in FIG. 3B is 182 mm, which corresponds to the width of B5 size paper. The length from the left end to the right end of the heat generating block HB4 is 105 mm, which corresponds to the width of A6 size paper.

Table 1 indicates a relationship between the width W of the recording material and classification of the heat generating blocks HB1 to HB7 on whether each heat generating block is a sheet passing block (where the recording material passes) or a non-sheet passing block (where the recording material does not pass). In Table 1, "sheet passing" indicates a sheet passing block, and "non-sheet passing" indicates a non-sheet passing block. By these heat generating blocks HB1 to HB7, a plurality of heating regions are formed in the fixing nip portion N. In the plurality of heating regions, sheet passing heating regions and non-sheet passing heating regions are formed corresponding to the sheet passing blocks and the non-sheet passing blocks in the heat generating blocks HB1 to HB7.

TABLE 1

| Width of recording material W | HB1 | HB2 | HB3 | HB4 | HB5 | HB6 | HB7 |
|---|---|---|---|---|---|---|---|
| 210 mm < W | Sheet passing | Sheet passing | Sheet passing | Sheet passing | Sheet passing | Sheet passing | Sheet passing |
| 182 mm < W ≤ 210 mm | Non-sheet passing | Sheet passing | Sheet passing | Sheet passing | Sheet passing | Sheet passing | Non-sheet passing |
| 105 mm < W ≤ 182 mm | Non-sheet passing | Non-sheet passing | Sheet passing | Sheet passing | Sheet passing | Non-sheet passing | Non-sheet passing |
| W ≤ 105 mm | Non-sheet passing | Non-sheet passing | Non-sheet passing | Sheet passing | Non-sheet passing | Non-sheet passing | Non-sheet passing |

In the image forming apparatus of Embodiment 1, the power to be supplied to each heat generating block is controlled so that the detection temperature of a thermistor (temperature detection unit) disposed in each heat generating block (described later) reaches a target temperature (target temperature value) that is set for each heat generating block. A target temperature in the sheet passing block is set to a temperature value that is required to fix a toner image to the recording material (target temperature of the sheet passing). A target temperature in the non-sheet passing block, on the other hand, is set to a temperature value that is as low as possible (target temperature of the non-sheet passing) in order to reduce power consumption.

The heat generating blocks HB1 to HB7 are constituted of heat generating members 302*a*-1 to 302*a*-7 and heat generating members 302*b*-1 to 302*b*-7 respectively, which are formed symmetrically with respect to the conveying direction of the recording material. The first conductor 301 is constituted of a conductor 301*a* which is connected with the heat generating members (302*a*-1 to 302*a*-7), and a conductor 301*b* which is connected with the heat generating members (302*b*-1 to 302*b*-7). In the same manner, the second conductor 303 is divided into seven (conductors 303-1 to 303-7) in order to support seven heat generating blocks HB1 to HB7.

Electrodes El to E7 are electrodes used for supplying power to the heat generating blocks HB1 to HB7 via the conductors 303-1 to 303-7. Electrodes E8-1 and E8-2 are electrodes used for connecting to a common electric contact, which is used for supplying power to the seven heat generating blocks HB1 to HB7, via the conductor 301*a* and the conductor 301*b*.

The surface protective layer 307 on the rear surface layer 2 of the heater 300 is formed so that the electrodes E1 to E7, E8-1 and E8-2 are exposed. Electric power is supplied to each heat generating member from the rear surface layer side of the heater 300 via each electrode.

On the sliding surface layer 1 on the side of the sliding surface (surface that contacts the endless belt) of the heater 300, thermistors T1-1 to T1-4 and thermistors T2-5 to T2-7 are disposed, and conductors are formed to supply power to the thermistors respectively. The temperatures of the heat generating blocks HB1 to HB7 of the heater 300 are detected by the thermistors T1-1 to T1-4 and the thermistors T2-5 to T2-7 respectively.

On the sliding surface layer 2 on the side of the sliding surface (surface that contacts the endless belt) of the heater 300, the surface protective layer 308 having sliding characteristics (glass in the case of Embodiment 1) is formed. The surface protective layer 308 is formed at least on a region where the film 202 slides, excluding both ends of the heater 300 where electric contacts of the conductors for detecting the resistance value of the thermistors are disposed.

Configuration of Control Block

Figure 4:
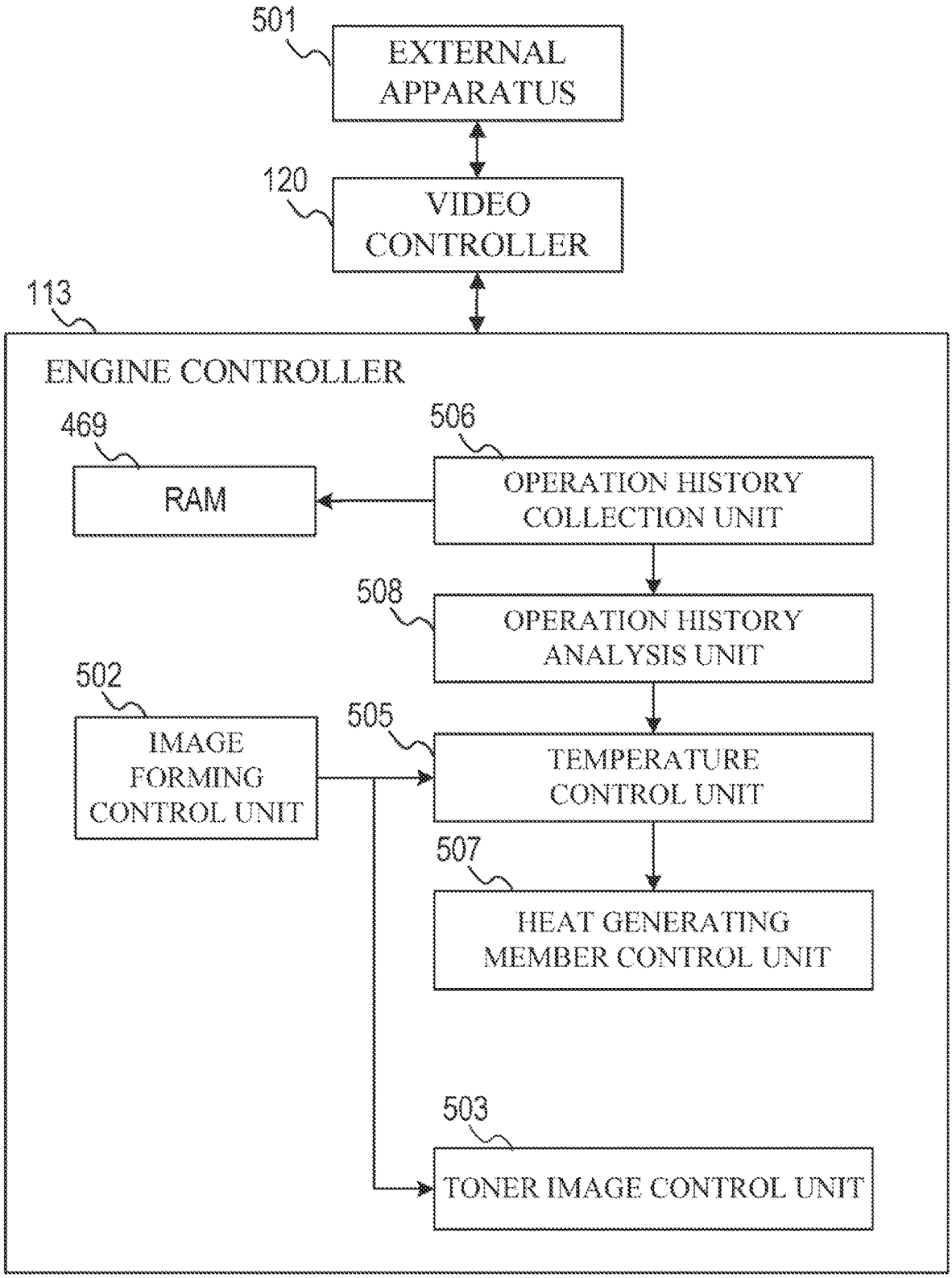
FIG. 4 is a control block diagram according to Embodiment 1.

FIG. 4 is a control block diagram depicting a control unit (control portion) of an image forming apparatus according to Embodiment 1.

The video controller 120 receives and processes image information and print instructions which are sent from an external apparatus 501 (e.g. host computer). When the image information and print instructions are received, the video controller 120 sends a pre-command to the engine controller 113. Then the video controller 120 converts the image information into printable information, and sends a print start command, along with print reserve information, to the engine controller 113.

The engine controller 113 is constituted of: an image forming control unit 502, a toner image control unit 503, an operation history collection unit 506, an operation history analysis unit (history analysis portion) 508, a temperature control unit 505, a heat generating member control unit 507 and a RAM (storage portion) 469, which will be described later.

The image forming control unit 502 executes a pre-heating sequence after a pre-command is received, executes a pre-rotation sequence in accordance with the print reserve information after a print start command is received, and executes a print sequence after a/TOP signal (not illustrated) is received. The print reserve information includes a print mode and a recording material size. The print mode indicates image forming conditions corresponding to the type of the recording material, and includes conveyance speed, transfer condition and target temperatures of fixing. The/TOP signal is a signal which the image forming control unit 502 sends to the video controller 120 when the pre-rotation sequence completes and transition to the print sequence becomes possible.

When the image forming control unit 502 instructs the print sequence, the toner image control unit 503 executes the series of operations mentioned above, and forms a toner image on the recording material.

When the image forming control unit 502 instructs the pre-heating sequence, pre-rotation sequence and print sequence, the temperature control unit 505 determines a target temperature of each heat generating block HB1 to HB7 controlled by the heat generating member control unit 507.

The operation history collection unit 506 stores the operation history (history information) of the print reserve information to the RAM 469 for each print. In Embodiment 1, the operation history to be collected includes the print reserve information (print mode, recording material size) and classification result of the heat generating blocks HB1 to HB7. The classification result of the heat generating blocks HB1 to HB7 is a result when the width W of the recording material is collated with Table 1 and each of the heat generating blocks HB1 to HB7 is classified whether the heat generating block is a sheet passing block or non-sheet passing block. For the operation history, the most recent 200 pages can be stored. Table 2 is an example of the operation history of the most recent 200 pages.

TABLE 2

| Page | Print mode | Recording material size | Classification result of leat generatng blocks HB1 to HB7 | | | | | | |
|---|---|---|---|---|---|---|---|---|---|
| | | | HB1 | HB2 | HB3 | HB4 | HB5 | HB6 | HB7 |
| First page | Plain paper | LETTER | Sheet passing | Sheet passing | Sheet passing | Sheet passing | Sheet passing | Sheet passing | Sheet passing |
| Second Page | Thick Paper | B5 | Non-sheet passing | Non-sheet passing | Sheet passing | Sheet passing | Sheet passing | Non-sheet passing | Non-sheet passing |
| Third page | Thin paper | B5 | Non-sheet passing | Non-sheet passing | Sheet passing | Sheet passing | Sheet passing | Non-sheet passing | Non-sheet passing |
| . . . | . . . | . . . | . . . | . . . | . . . | . . . | . . . | . . . | . . . |
| Two hundredth Page | Plain paper | B5 | Non-sheet passing | Non-sheet passing | Sheet passing | Sheet passing | Sheet passing | Non-sheet passing | Non-sheet passing |

The operation history analysis unit 508 analyzes the operation history collected by the operation history collection unit 506, and computes the print reserve information analysis result (analysis result of print related information). Table 3 and Table 4 indicate a print reserve information analysis result. In Embodiment 1, the number of printed pages in each print mode (Table 3) and the total values of the classification result of the heat generating blocks HB1 to HB7 (Table 4) are computed. In other words, (i) the type of the recording material which became the image forming target and the frequency when each type of recording material became the image forming target, and (ii) the frequency when each of a plurality of heating regions heated by the heater became the sheet passing region or the non-sheet passing region are acquired from the history information. The history information includes information, for each recording material on which the image forming operation is performed, on (i) the type of the recording material, and (ii) whether each of a plurality of heating regions which are respectively heated by the plurality of heat generating members is a sheet passing heating region where the recording material passes, or a non-sheet passing heating region where the recording material does not pass. The analysis result includes (i) a frequency in which the image forming operation is performed for each type of the recording material, and (ii) a frequency in which each of the plurality of heating regions becomes the sheet passing heating region or the non-sheet passing heating region. The operation history analysis unit stores the print reserve information analysis result in the RAM 469.

TABLE 3

| Print mode | Number of printed pages |
|---|---|
| Plain paper | 160 |
| Thick paper | 10 |
| Thin paper | 30 |

TABLE 4

| Classification result | Total value (pages) | | | | | | |
|---|---|---|---|---|---|---|---|
| | HB1 | HB2 | HB3 | HB4 | HB5 | HB6 | HB7 |
| Sheet passing block | 40 | 40 | 200 | 200 | 200 | 40 | 40 |
| Non-sheet passing block | 160 | 160 | 0 | 0 | 0 | 160 | 160 |

The heat generating member control unit 507 controls the output of power for each heat generating block, so that the detection temperature of the thermistor disposed in each heat generating block reaches the target temperature.

Control Flow Chart of Pre-Heating Sequence in Embodiment 1

Figure 5:
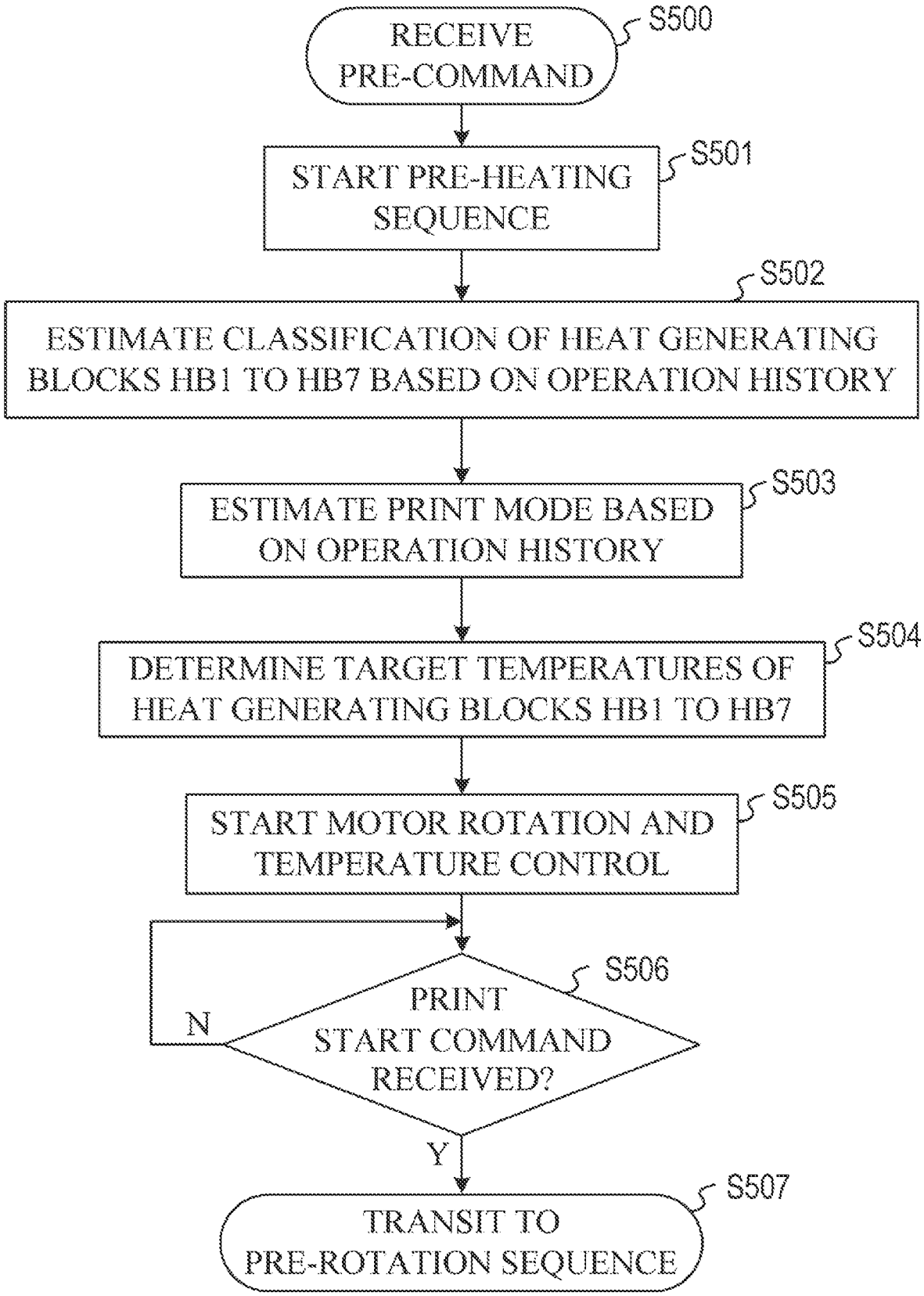
FIG. 5 is a control flow chart of a pre-heating sequence according to Embodiment 1.

FIG. 5 is a control flow chart of the pre-heating sequence in Embodiment 1. In this flow chart, the target temperatures of the pre-heating sequence are determined using the print reserve information analysis result.

In S500, the engine controller 113 receives the pre-command from the video controller 120.

In S501, the image forming control unit 502 included in the engine controller 113 instructs the toner image control unit 503 and the temperature control unit 505 to start the pre-heating sequence.

In S502, the temperature control unit 505 refers to the print reserve information analysis result computed by the operation history analysis unit 508, and checks the ratio of the non-sheet passing blocks for each heat generating block HB1 to HB7 respectively. If the ratio of the non-sheet passing blocks in each heat generating block in the most recent 200 pages of operation history is at least 80%, it is estimated that this heat generating block is more likely to become a non-sheet passing block. If the ratio (frequency) of the non-sheet passing blocks in each heat generating block in the most recent 200 pages of operation history is less than 80%, or if 200 pages of operation history is not stored in the operation history collection unit 506, it is estimated that this heat generating block is more likely to become a sheet passing block.

In S503, the engine controller 113 refers to the print reserve information analysis result to check the number of printed pages (frequency) for each print mode, and it is estimated that a print mode of which the number of printed pages is at least 80% of the most recent 200 pages is the print mode this time. If there is no print mode of which the number of printed pages is at least 80%, or if the operation history of the most recent 200 pages is not stored in the operation history collection unit 506, it is estimated that the thick paper mode in which the target temperature of the sheet passing block is the highest is likely to become the print mode this time.

In S504, target temperatures of the heat generating blocks HB1 to HB7 in the pre-heating sequence are set. The target temperature of a block, which is estimated as the sheet passing block, is set to a standby temperature (target temperature of the sheet passing block in the pre-heating sequence) to increase the temperature of each heat generating block to the target temperature of the sheet passing in the pre-rotation sequence. The target temperature of a block, which is estimated as the non-sheet passing block, is set to a minimum target temperature (target temperature of the non-sheet passing block in the pre-heating sequence) to reduce power consumption.

Table 5 indicates a target temperature of the sheet passing block in the pre-heating sequence and a target temperature of the non-sheet passing block in the pre-heating sequence for each mode which is set in S503. Since the temperature of the non-sheet passing block does not depend on the characteristics of the recording material and toner, the target temperature of the non-sheet passing block in the pre-heating sequence is constant, regardless the print mode.

TABLE 5

| Print mode | Target temperature of the sheet passing block in the pre-heating sequence [° C.] | Target temperature of the non-sheet passing block in the pre-heating sequence [° C.] |
|---|---|---|
| Plain paper | 170 | 120 |
| Thick paper | 180 | 120 |
| Thin paper | 150 | 120 |

In S505, the engine controller 113 starts rotary driving of the motor 30 and temperature control.

In S506, The engine controller 113 waits for receiving the print reserve information and the print start command from the video controller 120.

When the engine controller 113 receives the print reserve information and the print start command (Y in S506), the image forming control unit 502 included in the engine controller 113 instructs the toner image control unit 503 and the temperature control unit 505 to start the pre-rotation sequence in S507.

Control Flow Chart of Pre-Rotation Sequence in Embodiment 1

Figure 6:
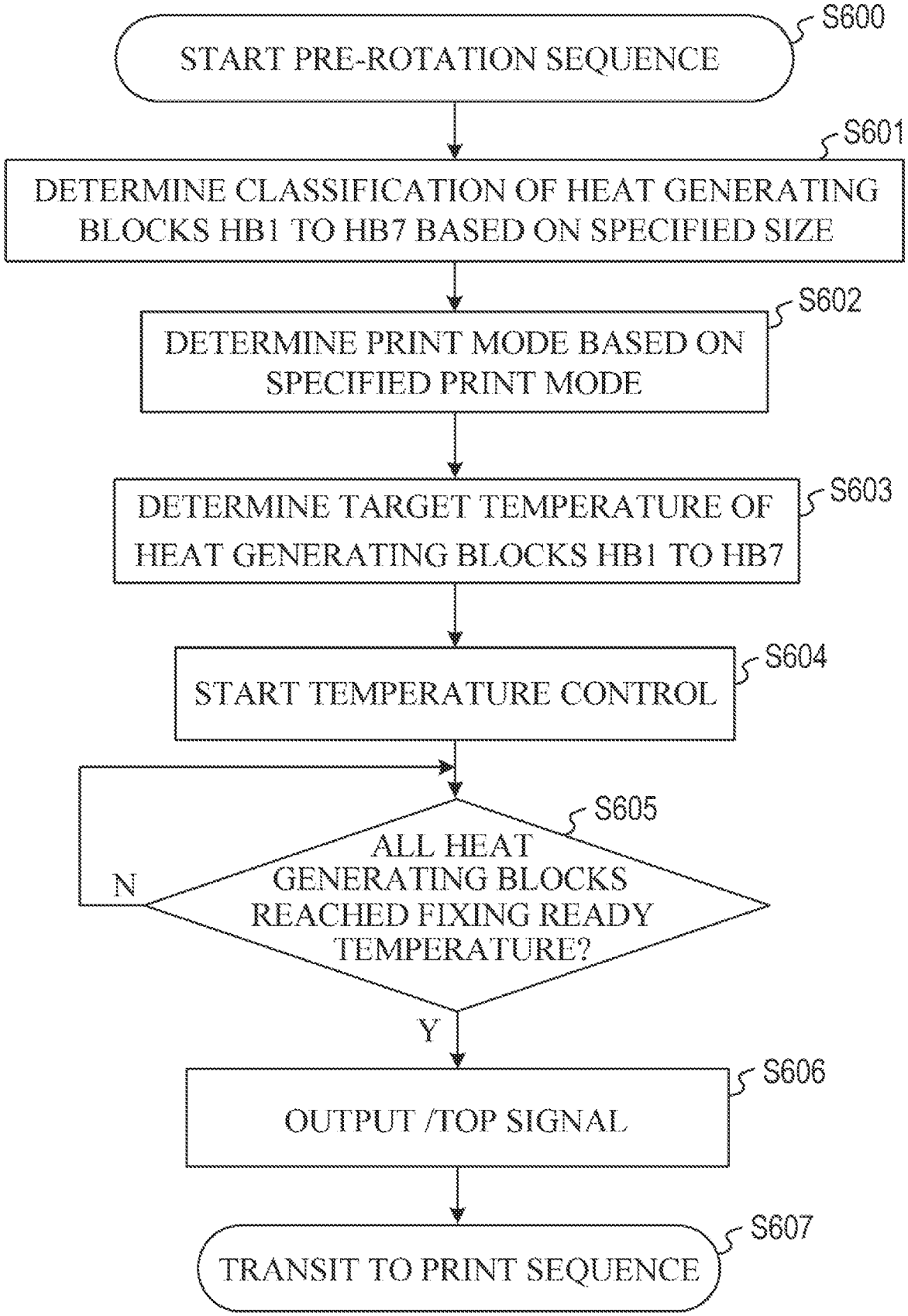
FIG. 6 is a control flow chart of a pre-rotation sequence according to Embodiment 1.

FIG. 6 is a control flow chart of the pre-rotation sequence in Embodiment 1.

In S600, the pre-rotation sequence starts, and in S601, the temperature control unit 505 collates the width W of the recording material specified in the print reserve information with Table 1, and determines whether each of the heat generating blocks HB1 to HB7 is classified to a sheet passing block or a non-sheet passing block respectively.

In S602, the engine controller 113 sets the print mode in the pre-rotation sequence and the print sequence to the print mode specified in the print reserve information.

In S603, the engine controller 113 sets the target temperatures of the heat generating blocks HB1 to HB7 in the pre-rotation sequence. The engine controller 113 sets the target temperature of the sheet passing block to the target temperature (target temperature of the sheet passing block in the print sequence) that is required to fix the toner image to the recording material, and sets the target temperature of the non-sheet passing block to the minimum target temperature (target temperature of the non-sheet passing block in the print sequence) to reduce power consumption.

Table 6 indicates the target temperature of the sheet passing block in the print sequence and the target temperature of the non-sheet passing block in the print sequence for each mode which is set in S602. Since the temperature of the non-sheet passing block does not depend on the characteristics of the recording material and toner, the target temperature of the non-sheet passing block in the print sequence is constant, regardless the print mode.

TABLE 6

| Print mode | Target temperature of sheet passing block in print sequence [° C.] | Target temperature of non-sheet passing block in print sequence [° C.] |
|---|---|---|
| Plain paper | 270 | 220 |
| Thick paper | 280 | 220 |
| Thin paper | 250 | 220 |

In S604, the engine controller 113 starts temperature control.

In S605, the engine controller 113 determines whether the detection temperature of the thermistor of each heat generating block reached a fixing ready temperature. The fixing ready temperature is a temperature that is set in advance, by which it can be determined that each heat generating block can reach the target temperature before the recording material enters the fixing nip portion N. The fixing ready temperature (Trdy) is computed for each heat generating block using Expression 1.

$$Trdy = Ttgt - \Delta Trdy \quad \text{(Expression 1)}$$

Ttgt indicates a target temperature of a heat generating block. ΔTrdy indicates an anticipated temperature increase of each heat generating block (set in advance) from the output point of the/TOP signal to the recording material entering the fixing nip portion N. In Embodiment 1, ΔTrdy=70° C. (value common to all heat generating blocks). When the temperature of the thermistor exceeds the fixing ready temperature in all the heat generating blocks, processing advances to S606.

In S606, the image forming control unit 502 outputs the/TOP signal to the video controller 120, and processing advances to S607.

In S607, the image forming control unit 502 instructs the toner image control unit 503 to start the print sequence, and the toner image control unit 503 starts the toner image forming operation.

Transition Example of Heating Block Temperature in Embodiment 1

In Embodiment 1, the history of the most recent 200 pages of print serve information is stored in the operation history collection unit 506, and is analyzed by the operation history analysis unit 508, and this print reserve information analysis result is indicated in Table 3 and Table 4. A transition example of the heat generating block temperatures in the case where printing is performed in this state will be described.

Figure 7:
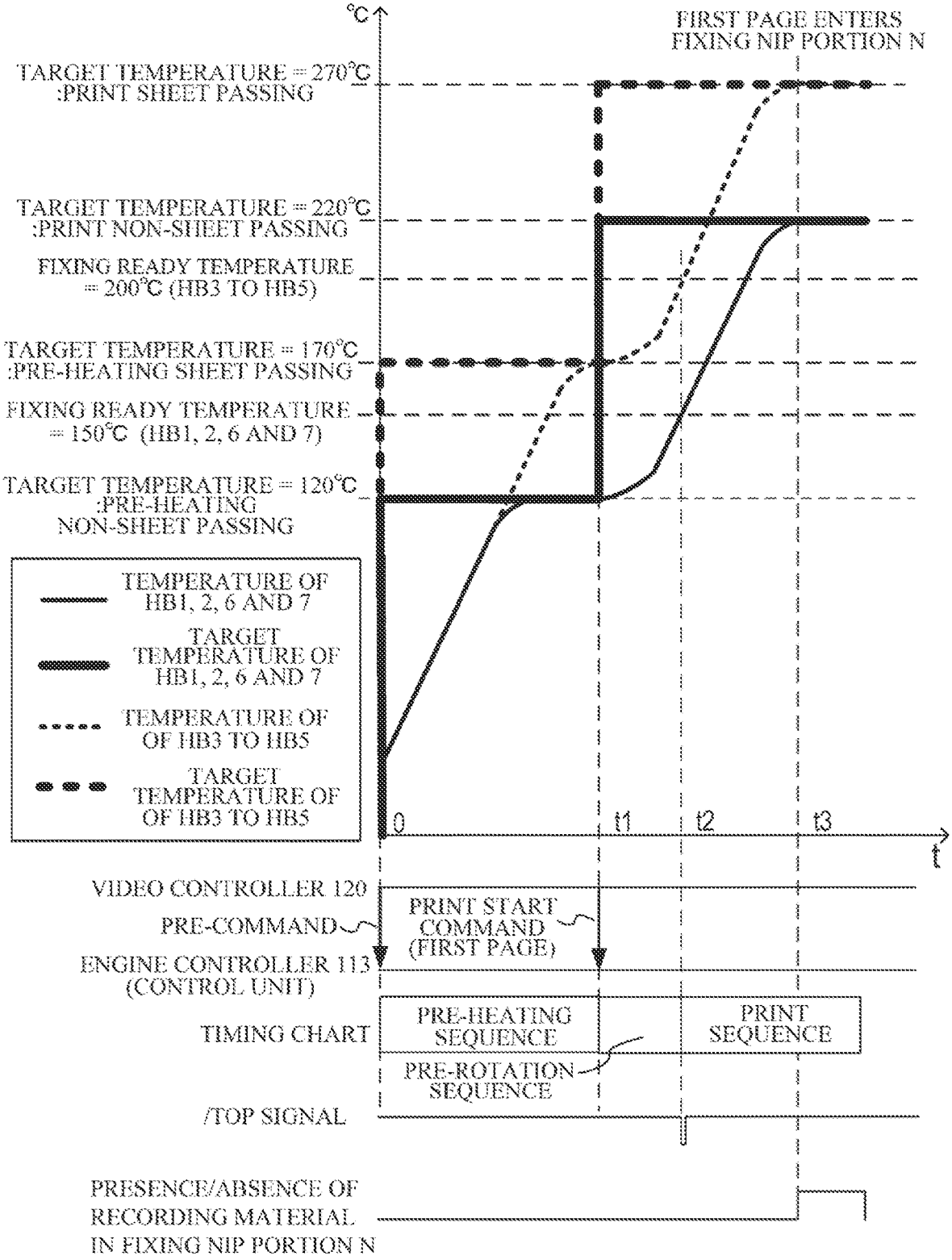
FIG. 7 is a diagram depicting temperature transition of heat generating blocks HB1 to HB7 according to Embodiment 1.

FIG. 7 is a transition example in the case of printing one page of B5 size plain paper, where the temperatures of the heat generating blocks HB1 to HB7, timing chart, /TOP signal and presence/absence of the recording material in the fixing nip portion N are indicated.

The time t=0 indicates the timing when the video controller 120 received a print instruction from the external apparatus 501. At this time, the video controller 120 sends the pre-command to the engine controller 113, and the pre-heating sequence (pre-heating operation) starts in accordance with the control flow chart in FIG. 5.

According to the classification result of the heat generating blocks HB1 to HB7 of the most recent 200 pages in Table 4, the heat generating blocks 3 to 5 are a 100% sheet passing block. The heating blocks HB1, 2, 6 and 7 are a 20% sheet passing block and 80% non-sheet passing block. Based on the estimation in S502, in the pre-heating sequence, the heat generating blocks HB3 to HB5 are set to the sheet passing blocks, and the heat generating blocks HB1, 2, 6 and 7 are set to the non-sheet passing blocks. Further, according to Table 3, at least 80% of the most recent 200 pages is in plain paper mode. Based on S503, the print mode in the pre-heating sequence is set to the plain paper mode. Then based on S504, the target temperatures of the heat generating blocks HB3 to HB5 in the pre-heating sequence are set to the target temperature 170° C. of the sheet passing block in the pre-heating sequence by the plain paper mode. The target temperatures of the heat generating blocks HB1, 2, 6 and 7 are set to the target temperature 120° C. of the non-sheet passing block in the pre-heating sequence.

Then in t=t1, the video controller 120 sends the print reserve information and the print start command to the engine controller 113. Thereby the pre-rotation sequence starts in accordance with the control flow chart in FIG. 6.

Since the specified recording material size is B5, it is determined based on Table 1 that the heat generating blocks HB3 to HB5 are the sheet passing blocks and the heat generating blocks HB1, 2, 6 and 7 are the non-sheet passing blocks. Further, since the specified print mode is the plain paper mode, the temperature control unit 505 sets the image forming target temperatures of the heat generating blocks HB3 to HB5 to 270° C., and the target temperatures of the heat generating blocks HB1, 2, 6 and 7 to 220° C. based on Table 6. The heat generating member control unit 507 controls the temperatures of the heat generating blocks HB1 to HB7 in accordance with the target temperatures that are set.

When all the heat generating blocks HB1 to HB7 reach the fixing ready temperatures, the image forming control unit 502 outputs the/TOP signal to the video controller 120 (t=t2).

After the heat generating blocks HB1 to HB7 reach the image forming target temperatures, the recording material on which a toner image is laid on enters the fixing nip portion N (t=t3), and is held and conveyed, whereby the unfixed toner image is fixed.

Control Flow Chart in Comparative Example 1

As Comparative Example 1, a case where printing is performed in a state of not storing the most recent 200 pages of operation history in the operation history collection unit 506 will be described. In Comparative Example 1, the operation of the pre-heating sequence is different from Embodiment 1, however the pre-rotation sequence is the same as Embodiment 1.

Figure 8:
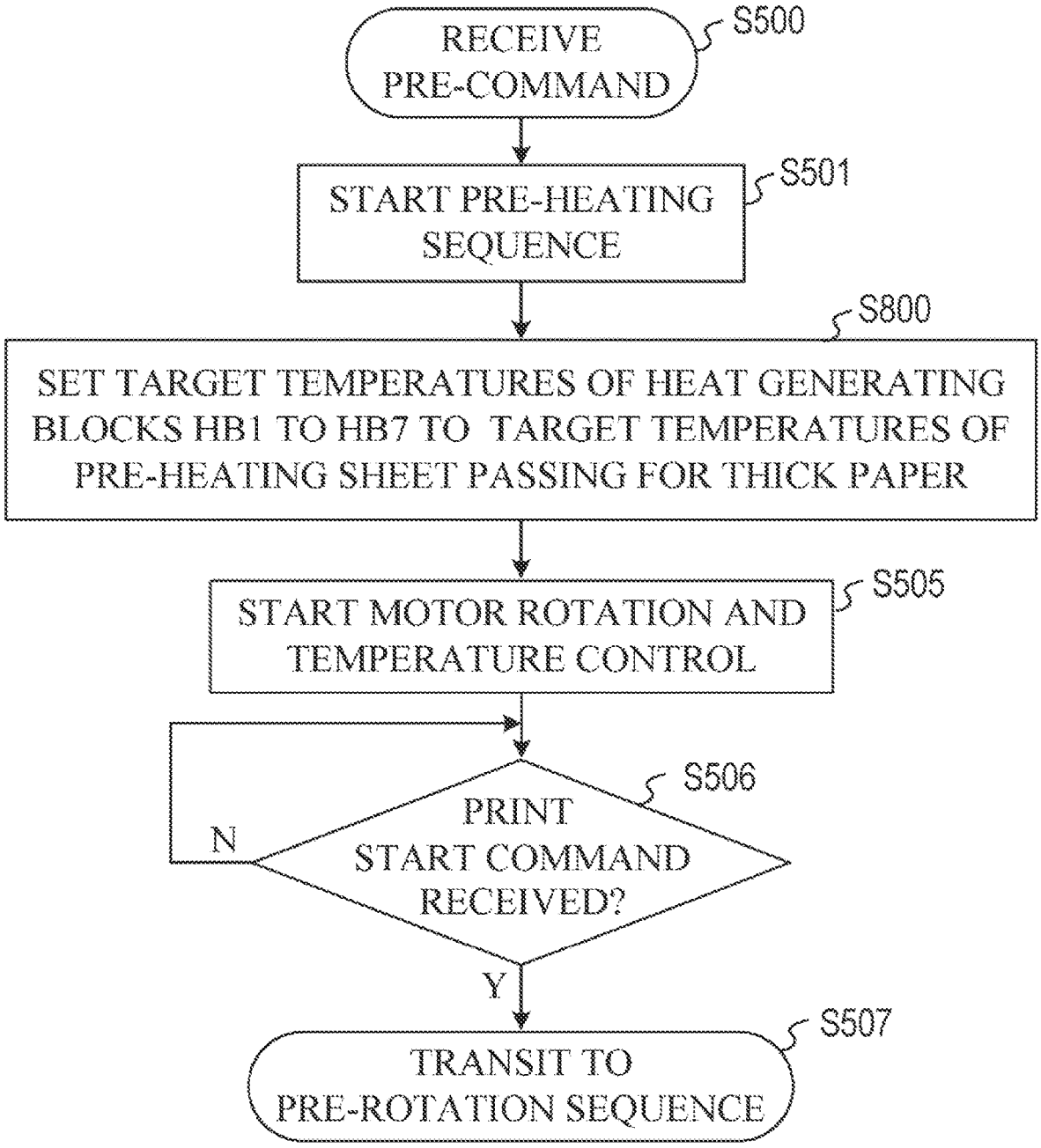
FIG. 8 is a control flow chart of a pre-heating sequence according to Comparative Example 1.

FIG. 8 is a control flow chart of the pre-heating sequence in Comparative Example 1. In Comparative Example 1, the target temperatures of the pre-heating sequence are determined without using the print reserve information analysis result.

S500 and S501 are the same as Embodiment 1 (FIG. 5).

When the operation of the pre-heating sequence starts in S501, pre-heating is performed so as to support all the sizes and all the modes, since the paper size and the print mode are not estimated in Comparative Example 1. In other words, in S800, the temperature control unit 505 sets the target temperature in the pre-heating sequence to the target temperature 180° C. of the sheet passing block in the pre-heating sequence for thick paper in Table 5 for all the blocks.

S505, S506 and S507 are the same as Embodiment 1 (FIG. 5).

Transition Example of Heating Generating Block Temperature in Comparative Example 1

A transition example of the heat generating block temperatures in the case where printing is performed according to Comparative Example 1 will be described.

Figure 9:
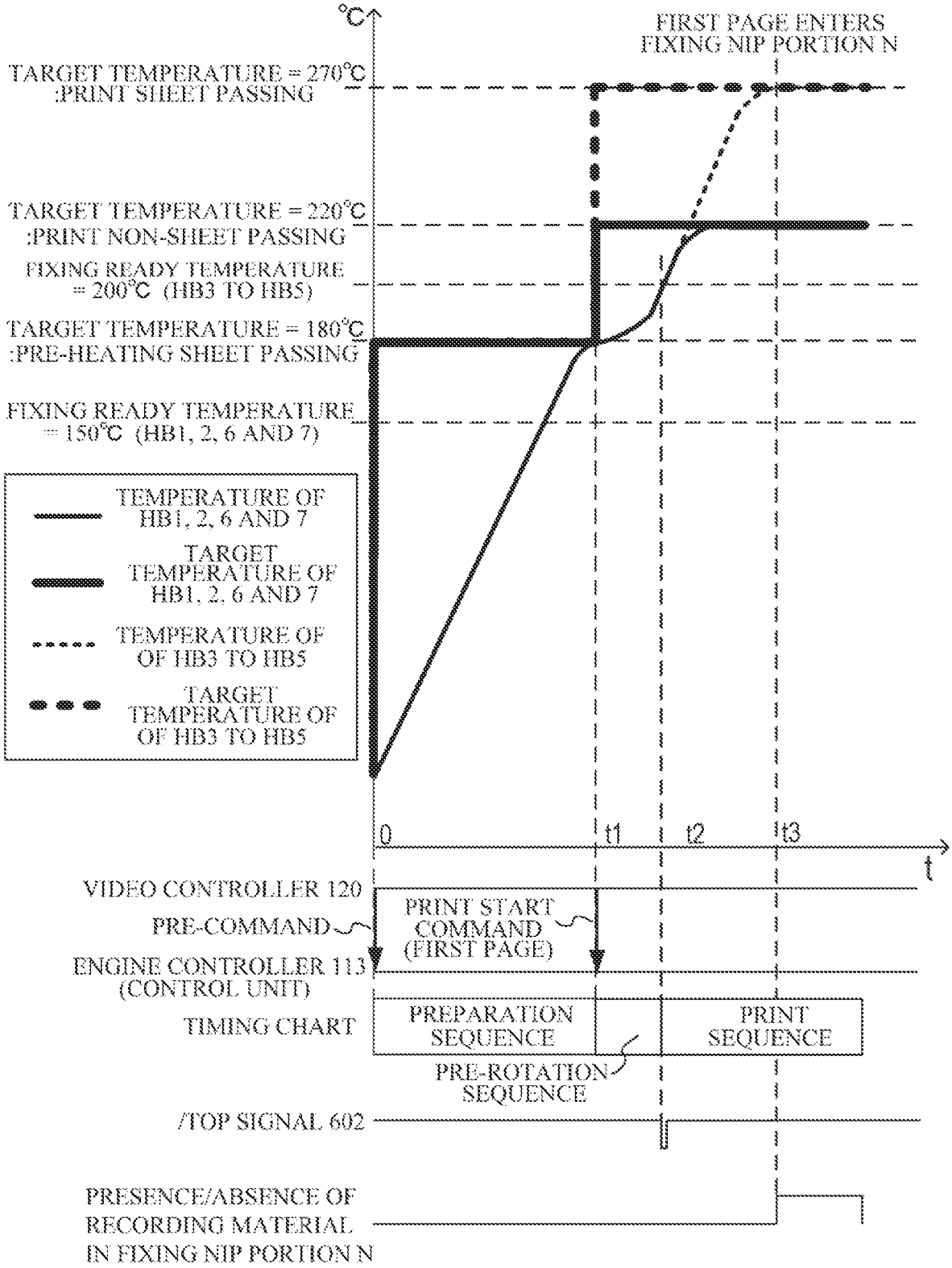
FIG. 9 is a diagram depicting a temperature transition of heat generating blocks HB1 to HB7 according to Comparative Example 1.

FIG. 9 is a transition example in the case of printing one page of B5 size plain paper, as described in FIG. 7, where the temperatures of the heat generating blocks HB1 to HB7, timing chart, /TOP signal and presence/absence of the recording material in the fixing nip portion N are indicated. The description on the portion overlapping with FIG. 7 will be omitted.

Based on S800, the target temperatures of the heat generating blocks HB1 to HB7 in the pre-heating sequence are set to the target temperature 180° C. of the sheet passing block in the pre-heating sequence for thick paper, and temperature is controlled.

Then at t=t1, the image forming control unit 502 instructs the temperature control unit 505 to perform temperature control in accordance with the print mode and recording material size specified in the print reserve information.

Since the specified recoding material size is B5, it is determined, based on Table 1, that the heat generating blocks HB3 to HB5 are the sheet passing blocks and the heat generating blocks HB1, 2, 6 and 7 are the non-sheet passing blocks. Further, since the specified print mode is the plain paper mode, the temperature control unit 505 sets the image forming target temperatures of the heat generating blocks HB3 to HB5 to 270° C., and the target temperatures of the heat generating blocks HB1, 2, 6 and 7 to 220° C. based on Table 6. The heat generating member control unit 507 controls the temperatures of the heat generating blocks HB1 to HB7 in accordance with the target temperatures that are set.

Transition Example When Estimated Size and Specified Size are Different in Embodiment 1

A case where the classification of heat generating blocks and the print mode estimated from the print reserve information analysis result are different from the classification of heat generating blocks and the print mode determined based on the print reserve information in Embodiment 1 will be described. In this case, the operation period of the pre-rotation sequence is changed so that the heat generating blocks HB1 to HB7 reach the image forming target temperatures before the recording material enters the fixing nip portion N.

Figure 10:
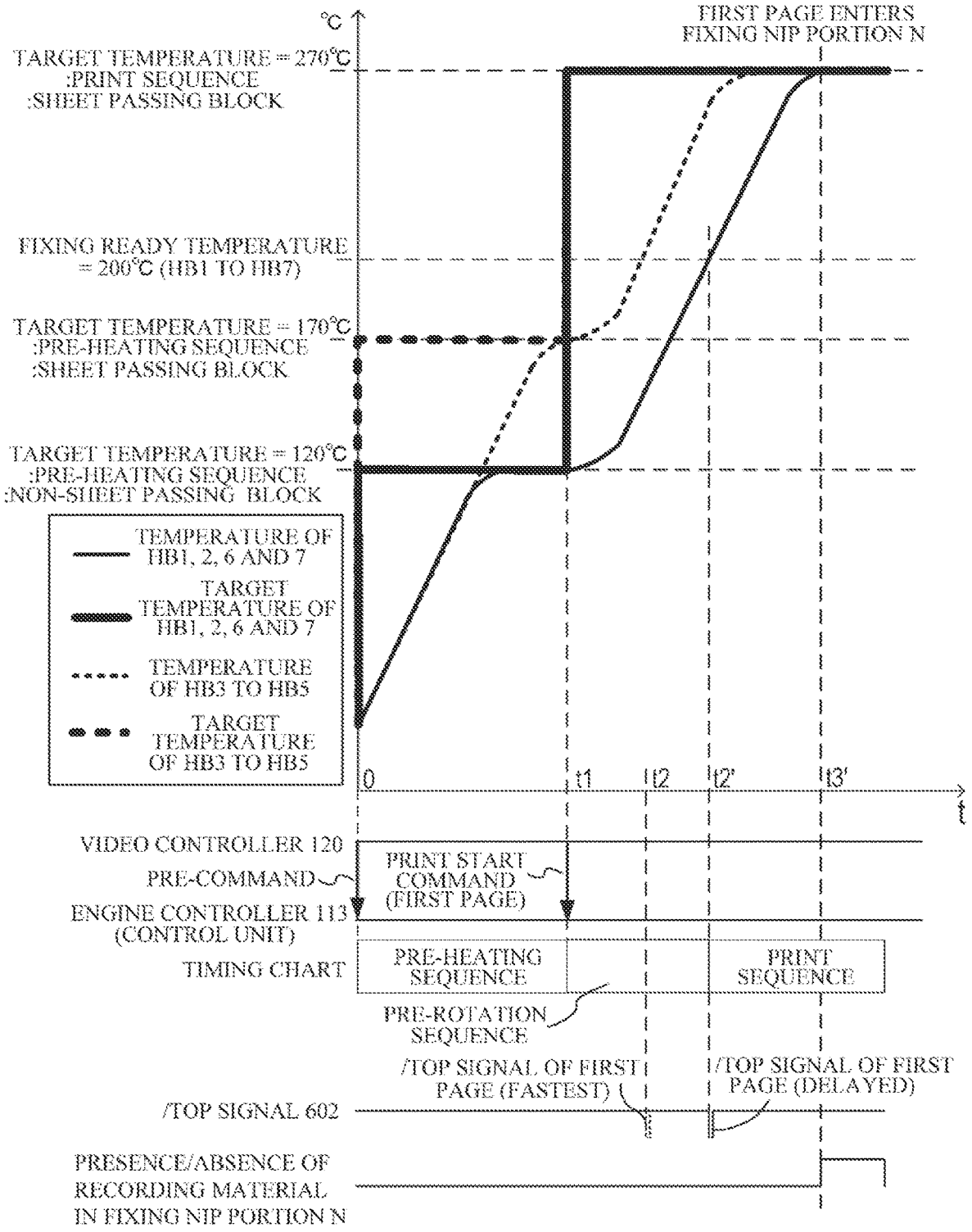
FIG. 10 is a diagram depicting a temperature transition of heat generating blocks HB1 to HB7 in the case where an estimated size and a specified size are different according to Embodiment 1.

FIG. 10 is an example when the classification of the heat generating blocks estimated based on the print reserve information analysis result is different from the classification of the heat generating blocks determined based on the print reserve information. FIG. 10 is a case where the letter size plain paper printing is received as the print reserve information after the pre-heating sequence is executed in accordance with the classification of the heat generating blocks estimated based on Table 4. FIG. 10 is a transition example in this case, where the temperatures of the heat generating blocks HB1 to HB7, timing chart, /TOP signal and presence/absence of a recording material in the fixing nip portion N are indicated. The print reserve information analysis result is the same as FIG. 7. The operation of the pre-heating sequence period is the same as FIG. 7, but the operation of the pre-rotation sequence period is different from FIG. 7.

When the print reserve information and print start command are sent at t=t1, the temperature control unit 505 determines that the heat generating blocks HB1 to HB7 are the sheet passing blocks based on Table 1, since the specified recording material size is the letter size. Further, since the specified print mode is the plain paper mode, the temperature control unit 505 sets the image forming target temperatures of the heat generating blocks HB1 to HB7 to 270° C., and the heat generating member control unit 507 controls the temperatures of the heat generating blocks HB1 to HB7 in accordance with the target temperatures that are set.

When the heat generating blocks HB1 to HB7 reach the fixing ready temperatures, the image forming control unit 502 outputs the/TOP signal to the video controller 120 (t=t2'). However, compared with the case of passing the B5 size paper, the fixing ready temperatures of the heat generating blocks HB1, 2, 6 and 7 are high, hence output of the/TOP signal delays, and the period of the pre-rotation sequence becomes longer.

After the heat generating blocks HB1 to HB7 reach the image forming target temperatures, the recording material on which a toner image is laid enters the fixing nip portion N (t=t3') and is held and conveyed, whereby the unfixed toner image is fixed.

Effect

In Embodiment 1 (FIG. 7) and Comparative Example 1 (FIG. 9), temperature control is performed so that the temperatures of the heat generating blocks reach the target temperatures and these temperatures are maintained, and a power that is required at this time is lower as the target temperature is smaller. In Embodiment 1, for a user who regularly prints small size paper, the instruction content to be determined later (type of recording material and content of image data) is estimated by referring to the operation history, and the target temperatures are set based on the estimation. In concrete terms, the target temperatures of the heat generating blocks HB1, 2, 6 and 7 in the pre-heating sequence are set to the non-sheet passing block target temperature 120° C., which is 60° C. lower than the target temperature 180° C. that is set in Comparative Example 1. Thereby power required to reach and maintain the target temperatures can be reduced.

Even in the case where the user prints a large size paper, printing at conventional quality can be provided by performing the sequence operation in accordance with the paper size.

Also for a user who does not print small size paper very much, printing can be performed at conventional print productivity.

As described above, according to Embodiment 1, a heating amount of the non-sheet passing block in the pre-heating sequence is changed before receiving the instruction of the print sequence, based on the print reserve information analysis result. Thereby for a user who regularly prints small size paper, an image forming apparatus that can reduce power consumption can be provided.

In other words, according to Embodiment 1, the heating amount of each heating region is set using the above mentioned method based on the operation history of the print related information. By recognizing in advance the operation tendencies of the user who repeatedly prints a specific print menu, the heating amount of each heat generating block can be adjusted to an optimum value matching with the operation tendencies, even if the print reserve information and image information are not determined. As a result, an image forming apparatus which can reduce power consumption and form an image at high image quality can be provided.

Modification

In Embodiment 1, the print reserve information analysis result is set as in Tables 3 and 4, but is not limited to this. Further, in Embodiment 1, the target temperatures are set as in Tables 5 and 6, but are not limited to these temperatures. Furthermore, in Embodiment 1, the target temperature of the non-sheet passing block in the pre-heating sequence is determined by referring to the target temperature of the non-sheet passing block in the pre-heating sequence of Table 5, but is not limited to this. For example, the ratio of the non-sheet passing block is assumed to be x %, and the target temperature Ttgtnp of the non-sheet passing block may be calculated by Expression 2.

$$Ttgtnp=(x\times Tnp+(100-x)\times Tp)/100 \quad \text{(Expression 2)}$$

Here Tnp is the target temperature of the non-sheet passing block in the pre-heating sequence determined by referring to Table 5, and Tp is the target temperature of the sheet passing block in the pre-heating sequence determined by referring to Table 5.

In Embodiment 1, the number of pages stored in the operation history collection unit 506 is 200, but is not limited to this, and may be an any number. The ratio (frequency) of various information which the temperature control unit 505 uses as a determination standard in S502 is not limited to a specific value, but may be set in accordance with the specifications of the apparatus, for example. In other words, 80% is used as a ratio of the non-sheet passing blocks to determine whether each heat generating blockHB1 to HB7 is the non-sheet passing block or the sheet passing block, or as a ratio to determine the print mode based on the print reserve information analysis result in the pre-heating sequence, but the ratios are not limited to these.

Further, in Embodiment 1, a case of printing B5 size plain paper was described as an example, but any size or any print mode may be used.

Further, in Embodiment 1, if the 200 pages of operation history of the print related information is not stored, it is estimated that the print mode is the thick paper mode, and the heat generating blocks HB1 to HB7 are all sheet passing blocks. But the embodiments of the present invention are not limited to this, and the print mode may be estimated as the plain paper mode or the thin paper mode, and the heat generating blocks HB1 to HB7 may be estimated as the non-sheet passing blocks. For example, if the print mode is estimated as the plain paper mode and the heat generating blocks HB1, 2, 6 and 7 in the pre-heating sequence are estimated as the non-sheet passing blocks, the target temperatures of the heat generating blocks HB1, 2, 6 and 7 in the pre-heating sequence can be decreased to 120° C., even if the 200 pages of operation history is not stored, and power consumption can be reduced. If the print reserve information is then determined and the classification of the heat generating blocks HB1 to HB7 turns out to be different from what was estimated, the operation period of the pre-rotation sequence is changed so that the heat generating blocks HB1 to HB7 reach the image forming target temperatures of before the recording material enters the fixing nip portion N, just like Embodiment 1.

Embodiment 2

In Embodiment 2, an example of reducing power consumption, by changing the heating amounts of the heat generating blocks HB1 to HB7 in the pre-heating sequence based on the history of the image information, will be described. The configurations of the image forming apparatus, image heating apparatus, heater and heat generating blocks are the same as FIGS. 1 to 4 in Embodiment 1. Aspects that are not especially described in Embodiment 2 are the same as Embodiment 1.

Configuration of Control Block

The control block of Embodiment 2 will be described in detail with reference to FIG. 4.

Just like Embodiment 1, the video controller 120 converts the image data received from the external apparatus 501 into printable information, and sends a print start command, along with print reserve information, to the engine controller 113. At the same time, the video controller 120 acquires image density data from the received image data, converts the image density data into image information (later mentioned Maxink values) for use in the image forming apparatus, and sends the image information to the engine controller 113. This conversion method will be described.

The video controller 120 converts the received image data into image density data of each color of CMYK. The image density data of each color, that is, d (C), d (M), d (Y) and d (K) are expressed by a range from the minimum density 00h (toner amount: 0%) to the maximum density FFh (toner amount: 100%) in accordance with the occupying degree of each color in a unit pixel area to determine the density. A total value d(CMYK), which is the total of these image density data d (C), d (M), d (Y) and d (K) is used as the toner amount conversion value (%). In Embodiment 2, the unit pixel area is 16 dots×16 dots of 600 dpi.

In Embodiment 2, the toner amount 0.5 mg/cm$^2$ on the recording material P is regarded as 100%, and the video controller 120 performs adjustment so that the toner amount conversion value does not exceed 230%.

The video controller 120 calculates the maximum value (Maxink) of the toner amount conversion value for the width of each heat generating block HB1 to HB7, and notifies the Maxink value (%) of each heat generating block to the engine controller 113.

The temperature control unit 505 corrects the target temperature of the sheet passing block of each heat generating block HB1 to HB7 (determined based on Table 5) in according with the Maxink values. The target temperature of the sheet passing block in Table 5 is set as a temperature in the case where the Maxink value is 230%. Therefore if the Maxink value is 100%, for example, the target temperature can be decreased by 10° C. compared with the case where the Maxink value is 230%. This is because heat to sufficiently melt toner decreases as the toner amount is smaller.

Table 7 indicates the correction temperature (correction temperature value) ΔTp of the target temperature with respect to the Maxink.

TABLE 7

| Maxink [%] | Correction temperature ΔTp [° C.] |
|---|---|
| 0 | −20 |
| 1 to 20 | −18 |
| 21 to 50 | −15 |
| 51 to 100 | −12 |
| 101 to 150 | −10 |
| 151 to 180 | −5 |
| 181 to 200 | −2 |
| 201 to 230 | 0 |

The temperature control unit 505 determines the target temperature Ttgtp of the sheet passing block using Expression 3.

$$Ttgtp = Tp + \Delta Tp \quad \text{(Expression 3)}$$

Tp is the target temperature of the sheet passing block specified in Table 6, and ΔTp is a correction temperature for each Maxink value specified in Table 7.

In Embodiment 2, the operation history collection unit 506 stores the Maxink value for each heat generating block as the operation history. Table 8 is an example of the operation history of the most recent 200 pages.

TABLE 8

| | Maxink [%] | | | | | | |
|---|---|---|---|---|---|---|---|
| Page | HB1 | HB2 | HB3 | HB4 | HB5 | HB6 | HB7 |
| First page | 100 | 100 | 100 | 100 | 100 | 100 | 100 |
| Second page | 0 | 0 | 100 | 100 | 100 | 0 | 0 |
| Third page | 0 | 0 | 120 | 120 | 120 | 0 | 0 |
| . . . | . . . | . . . | . . . | . . . | . . . | . . . | . . . |
| Two hundredth page | 0 | 0 | 150 | 150 | 150 | 0 | 0 |

Further, the operation history analysis unit 508 computes the image information analysis result (print related information analysis result). Table 9 is an example of the image information analysis result. The number of printed pages with each Maxink value for each heat generating block is tabulated as the frequency distribution. In this frequency distribution, the number of printed pages is accumulated in sequence from the lower Maxink value, and the Maxink value (estimated Maxink value) with which the accumulated number of printed pages exceeds 160 pages, that is, 80% of the total is determined for each heat generating block HB1 to HB7 respectively. The estimated Maxink values of the heat generating blocks HB1 to HB7 comprise the image information analysis results.

TABLE 9

| | Number of printed pages (pages) | | | | | | |
|---|---|---|---|---|---|---|---|
| Maxink [%] | HB1 | HB2 | HB3 | HB4 | HB5 | HB6 | HB7 |
| 0 | 160 | 160 | 10 | 10 | 10 | 160 | 160 |
| 1 to 20 | 0 | 0 | 0 | 0 | 0 | 0 | 0 |
| 21 to 50 | 0 | 0 | 0 | 0 | 0 | 0 | 0 |
| 51 to 100 | 40 | 40 | 90 | 90 | 90 | 40 | 40 |
| 101 to 150 | 0 | 0 | 60 | 60 | 60 | 0 | 0 |
| 151 to 180 | 0 | 0 | 20 | 20 | 20 | 0 | 0 |
| 181 to 200 | 0 | 0 | 10 | 10 | 10 | 0 | 0 |
| 201 to 230 | 0 | 0 | 10 | 10 | 10 | 0 | 0 |

Control Flow Chart of Pre-Heating Sequence in Embodiment 2

Figure 11:
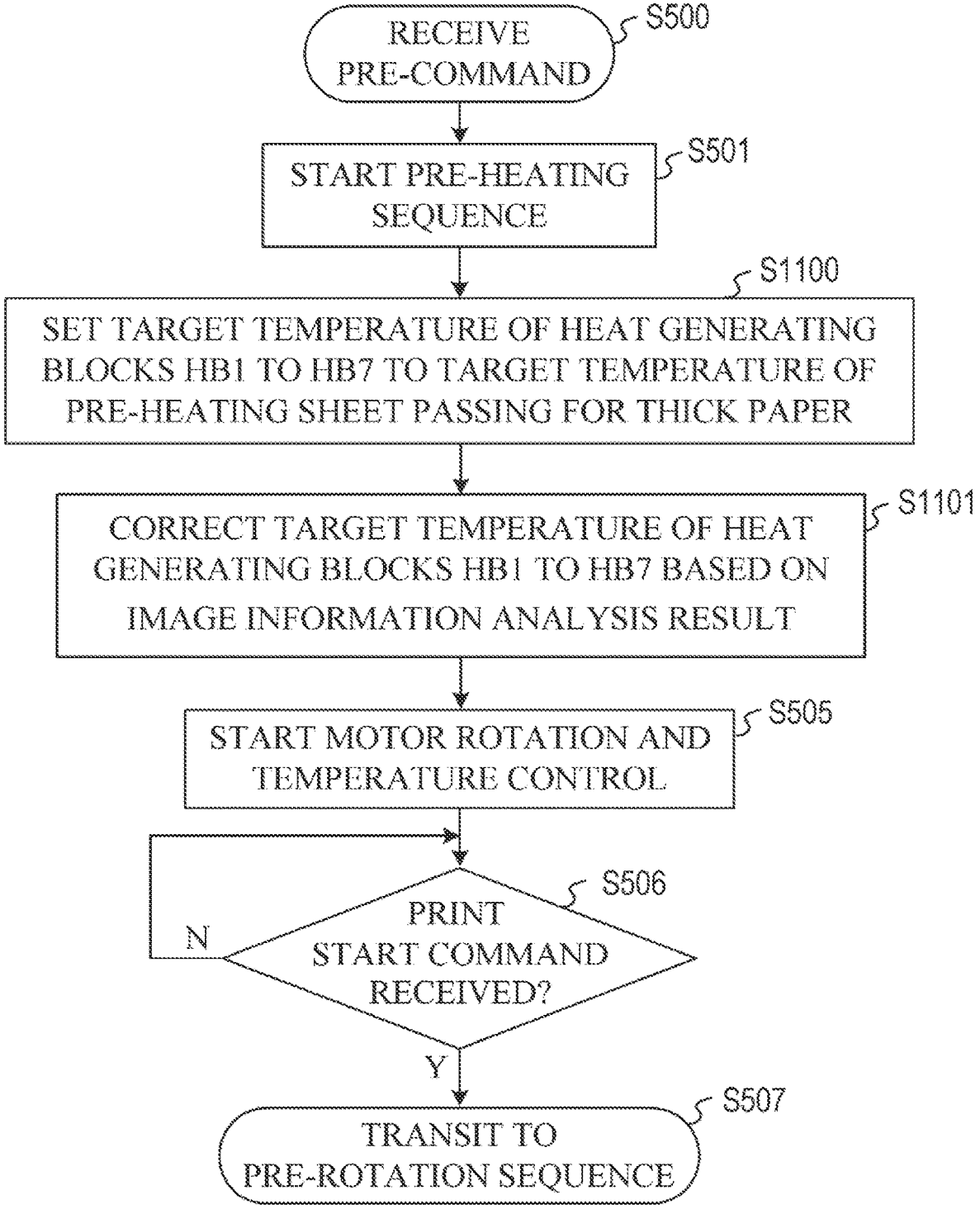
FIG. 11 is a control flow chart of a pre-heating sequence according to Embodiment 2.

FIG. 11 is a control flow chart of the pre-heating sequence of Embodiment 2. In this flow chart, the target temperatures of the pre-heating sequence are determined using the image information analysis result.

S500 and S501 are the same as the operations in Embodiment 1 (FIG. 5).

In S1100, the temperature control unit 505 sets the target temperature of the pre-heating sequence to the target temperature of the sheet passing block in the pre-heating sequence for the thick paper in Table 5, which is 180° C.

In S1101, the temperature control unit 505 determines the correction temperatures for the heat generating blocks HB1 to HB7 based on the image information analysis result (estimated Maxink values of heat generating blocks HB1 to HB7) and Table 7, and corrects the target temperatures of heat generating blocks HB1 to HB7 in the pre-heating sequence. If 200 pages of operation history is not stored in the operation history collection unit 506, correction using the estimated Maxink values of the target temperatures of the non-sheet passing blocks in the pre-heating sequence is not performed.

S505 to S507 are the same as the operations in Embodiment 1 (FIG. 5).

Control Flow Chart of Pre-Rotation Sequence in Embodiment 2

Figure 12:
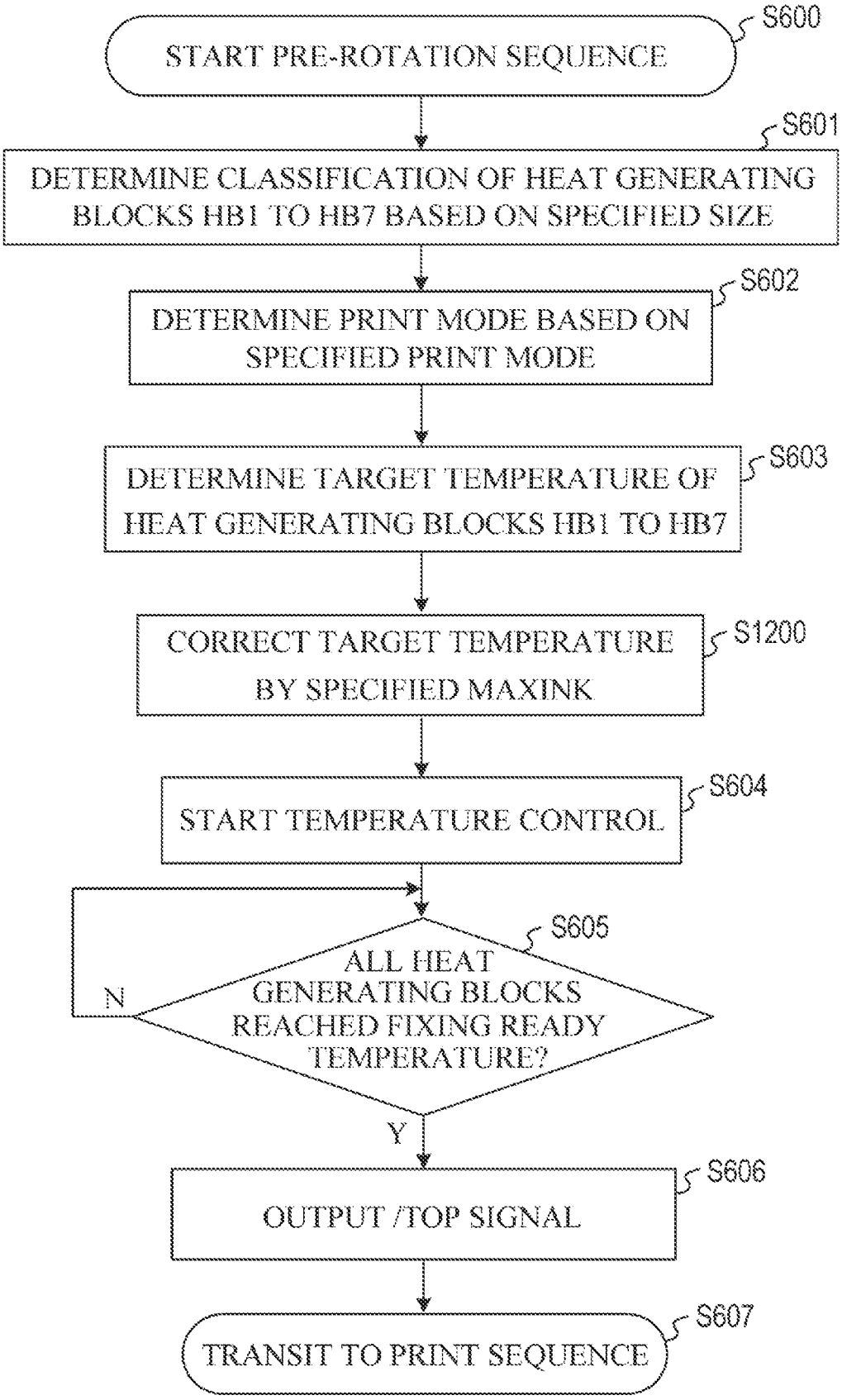
FIG. 12 is a control flow chart of a pre-rotation sequence according to Embodiment 2.

FIG. 12 is a control flow chart of the pre-rotation sequence in Embodiment 2.

S600 to S603 are the same as the operations in Embodiment 1 (FIG. 6).

In S1200, the temperature control unit 505 determines the correction temperatures based on the Maxink (specified Maxink) values sent from the video controller 120 and Table 7, and corrects the target temperatures of the heat generating blocks HB1 to HB7.

S604 to S607 are the same as the operations in Embodiment 1 (FIG. 6).

Transition Example of Heating Generating Block Temperature in Embodiment 2

In Embodiment 2, the history of the most recent 200 pages of image information is stored in the operation history collection unit 506, is analyzed by the operation history analysis unit 508, and this image information analysis result (estimated Maxink values) is indicated in Table 9. A transition example of the heat generating block temperatures in the case where printing is performed in this state will be described.

Figure 13:
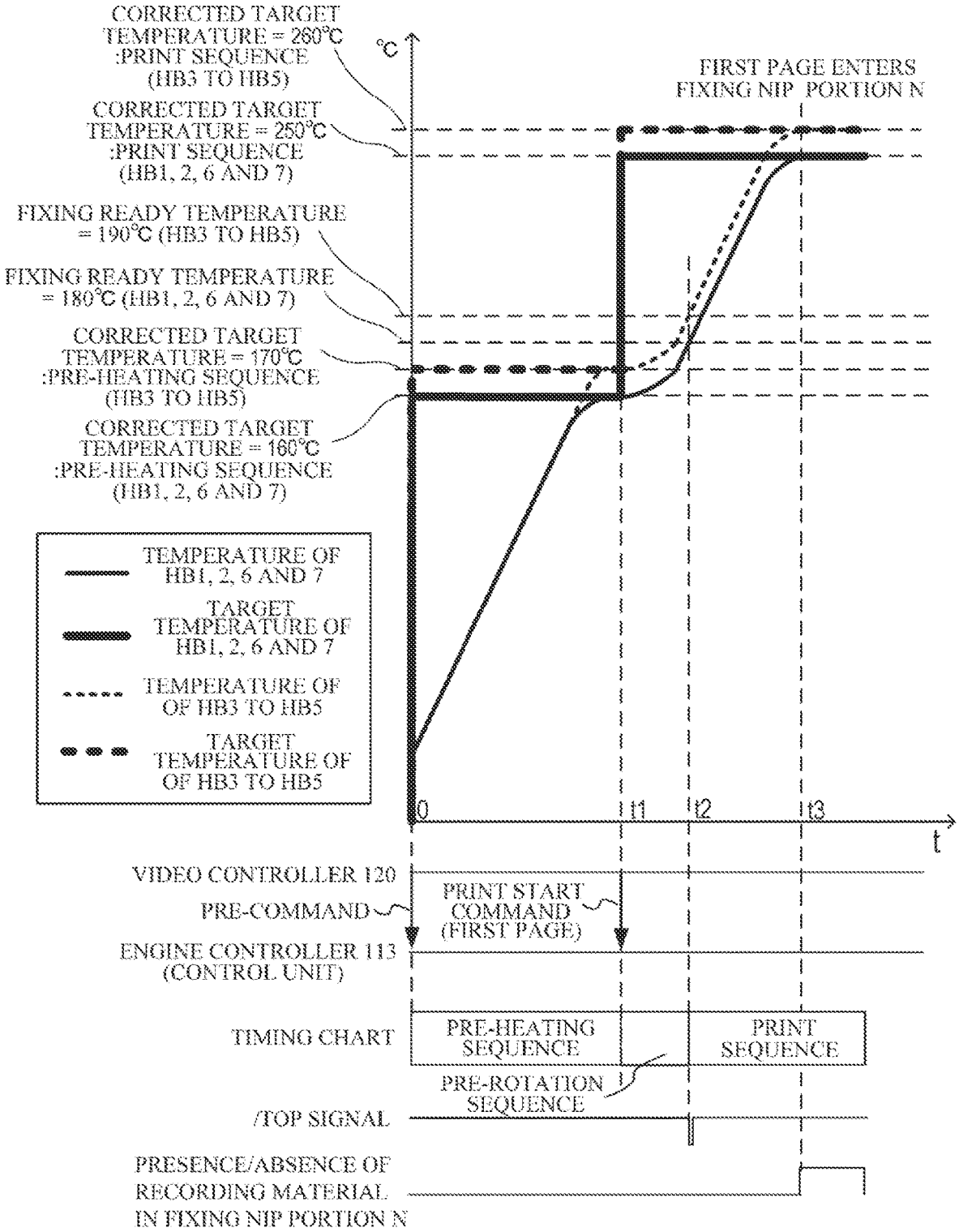
FIG. 13 is a diagram depicting a temperature transition of heat generating blocks HB1 to HB7 according to Embodiment 2.

FIG. 13 indicates a case of printing one page of letter size plain paper, where the Maxink values of the heat generating blocks HB3 to HB5 are 120%, and the Maxink values of the heat generating blocks HB1, 2, 6 and 7 are 0%. FIG. 13 is a transit example in this case, where the temperatures of the heat generating blocks HB1 to HB7, timing chart, /TOP signal and presence/absence of the recording material in the fixing nip portion N are indicated.

Just like Embodiment 1, at the time t=0, the video controller 120 sends the pre-command to the engine controller 113.

Hereafter the heat generating member control unit 507 controls the temperatures of the heat generating blocks HB1 to HB7 in the same procedure as Embodiment 1, in accordance with the target temperatures which are set. Here the target temperatures of the heat generating blocks HB1 to HB7 in the pre-heating sequence are set to the target temperature of the sheet passing block in the pre-heating sequence for the thick paper, which is 180° C., based on S1100.

In Embodiment 2, the number of printed pages of each heat generating block HB1 to HB7 for each Maxlink in Table 9 is accumulated sequentially from the lower Maxink value. In the heat generating blocks HB3 to HB5, the range of the Maxink with which the accumulated number of pages exceeds 160 pages, that is, 80% of the total is 101 to 150%, hence the estimated Maxink value is set to 101 to 150%. The temperature control unit 505 collates the estimated Maxink value and Table 7, and determines that the correction temperature is −10° C., and sets the target temperatures of the heat generating blocks HB3 to HB5 in the pre-heating sequence to 170° C. In the heat generating blocks HB1, 2, 6 and 7, the range of the Maxink values with which the accumulated number of pages exceeds 160 pages, that is 80% of the total is 0%, hence the estimated Maxink value is set to 0%. The temperature control unit 505 collates the estimated Maxink value and Table 7, determines that the correction temperature is −20° C., and sets the target temperatures of the heat generating blocks HB1, 2, 6 and 7 in the pre-heating sequence to 160° C. (S1101).

When an instruction of the video controller 120 is received at t=t1, the image forming control unit 502 instructs the temperature control unit 505 to perform temperature control in accordance with the print mode, the recording material size specified in the print reserve information, and the Maxink values specified in the image information.

Since the specified size is letter size, it is determined based on Table 1 that the heat generating blocks HB1 to HB7 are the sheet passing blocks. Further, since the print mode is the plain paper mode, the target temperatures of the heat generating blocks HB1 to HB7 are set to 270° C. based on Table 6. Further, since the specified Maxink values of the heat generating blocks HB3 to HB5 are 120%, the temperature control unit 505 sets the correction temperature to −10° C., and the corrected target temperatures of the control blocks HB3 to HB5 are set to 260° C. based on Table 7. Furthermore, since the specified Maxink values of the heat generating blocks HB1, 2, 6 and 7 are 0%, the temperature control unit 505 sets the correction temperature to −20° C., and sets the corrected target temperatures of the heat generating blocks HB1, 2, 6 and 7 to 250° C. based on Table 7 (S1200). The heat generating member control unit 507 controls the temperatures of the heat generating blocks HB1 to HB7 in accordance with the target temperatures that are set.

Hereafter the unfixed toner image on the recording material is fixed by the same procedure as Embodiment 1.

Control Flow Chart in Comparative Example 2

As Comparative Example 2, a case where printing is performed in a state of not storing the most recent 200 pages of operation history in the operation history collection unit 506 will be described. In Comparative Example 2, the operation of the pre-heating sequence is the same as Comparative Example 1, and the pre-rotation sequence is the same as Embodiment 2.

Transition Example of Heating Generating Block Temperature in Comparative Example 2

Figure 14:
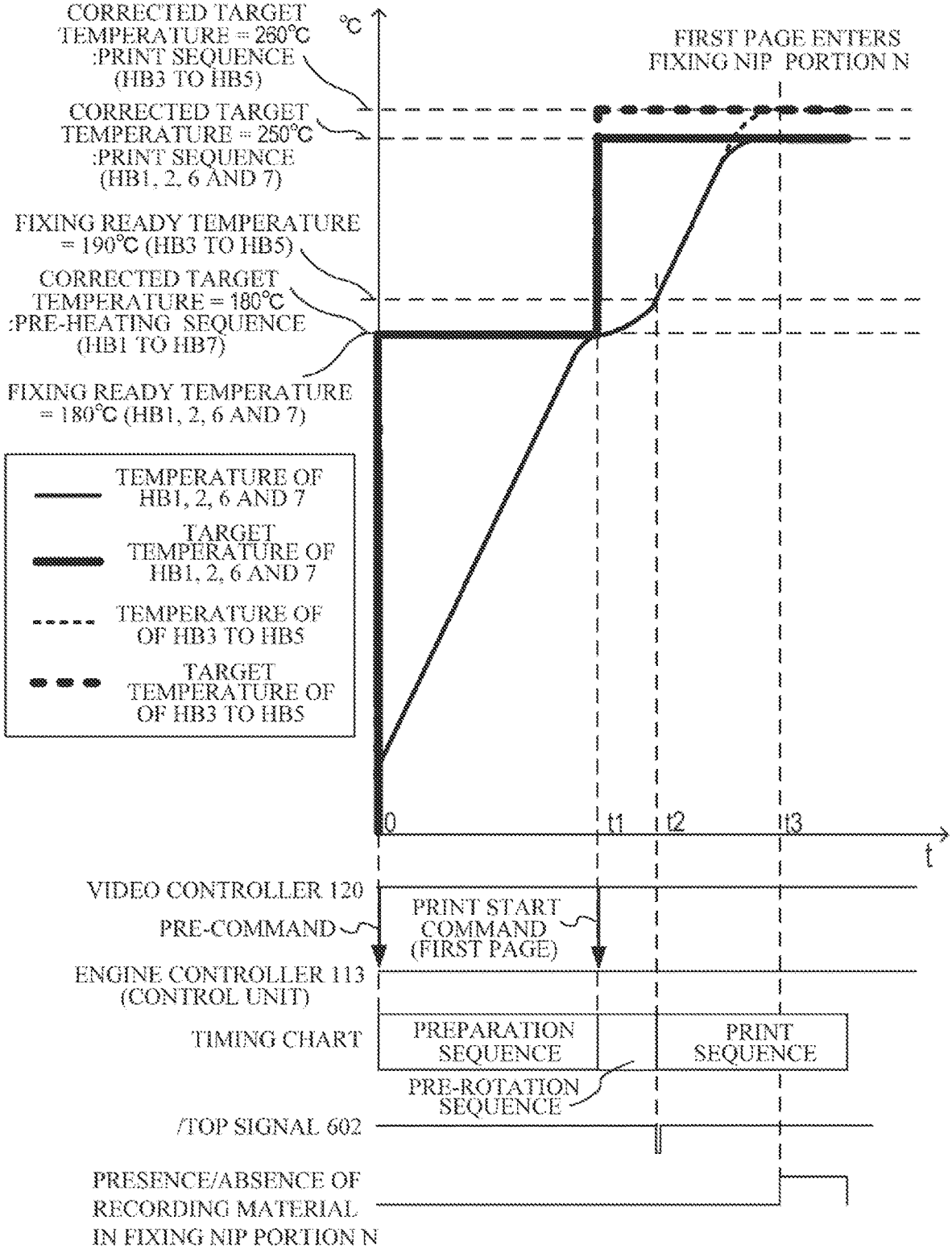
FIG. 14 is a diagram depicting a temperature transition of heat generating blocks HB1 to HB7 according to Comparative Example 2.

FIG. 14 is a transition example of Comparative Example 2 in the case of printing one page of an image as described in FIG. 13, where the temperatures of the heat generating blocks HB1 to HB7, timing chart, /TOP signal, and presence/absence of the recording material in the fixing nip portion N are indicated.

Just like Embodiment 2, when the image forming control unit 502 instructs the temperature control unit 505 to start the pre-heating sequence at time t=0, the heat generating member control unit 507 controls the temperatures of the heat generating blocks HB1 to HB7 in accordance with the target temperatures that are set. Here, based on S800, the target temperatures of the heat generating blocks HB1 to HB7 in the pre-heating sequence are set to the target temperature 180° C. of the sheet passing block in the pre-heating sequence for the thick paper.

Then at t=t1, the image forming control unit 502 instructs the temperature control unit 505 to perform temperature control in accordance with the print mode, the recording material size specified in the print reserve information, and the Maxink value specified in the image information.

Since the specified size is letter size, it is determined based on Table 1 that the heat generating blocks HB1 to HB7 are the sheet passing blocks. Further, since the specified print mode is the plain paper mode, the target temperatures of the heat generating blocks HB1 to HB7 are set to 270° C. based on Table 6. Since the specified Maxink values of the heat generating blocks HB3 to HB5 are 120%, the temperature control unit 505 sets the correction temperature to −10° C. based on Table 7, and sets the target temperatures of the heat generating blocks HB3 to HB5 to 260° C. Further, since the specified Maxink values of the heat generating blocks HB1, 2, 6 and 7 are 0%, the temperature control unit 505 sets the correction temperature to −20° C. based on Table 7, and sets the target temperatures of the heat generating blocks HB1, 2, 6 and 7 to 250° C. The heat generating member control unit 507 controls the heat generating blocks HB1 to HB7 in accordance with the target temperatures that are set.

Hereafter the unfixed toner image on the recording material is fixed by the same procedure described above.

Transition Example in the Case Where Estimated Maxink and Specified Maxink are Different in Embodiment 2

The case where the estimated Maxink value estimated in the pre-heating sequence and the specified Maxink value specified in the pre-rotation sequence are different in Embodiment 2 can be handled based on the same concept described in Embodiment 1. In other words, the operation period of the pre-rotation sequence is changed so that the heat generating blocks HB1 to HB7 reach the image forming target temperatures before the recording material enters the fixing nip portion N.

Effect

In Embodiment 2, in the case where printing according to a specified layout is repeatedly performed, the tendencies of the print image pattern of the user are recognized, and based on the recognition result, the control target temperatures in the pre-heating sequence are set. In concrete terms, the target temperatures of the heat generating blocks HB3 to HB5 are set to 170° C., which is 10° C. lower than the target temperature 180° C. that is set in Comparative Example 2. Further, the target temperatures of the heat generating blocks HB1, 2, 6 and 7 are set to 160° C., which is 20° C. lower than the target temperature 180° C. that is set in Comparative Example 2. Thereby power required to reach and maintain the target temperature can be reduced.

Even in the case where the user prints an image that is different from the above image, printing at conventional quality can be provided by performing the sequence operation in according with the type of images.

For the user who prints various layout print images as well, printing can be performed at conventional print productivity.

As described above, according to Embodiment 2, a heating amount for the sheet passing block in the pre-heating sequence is changed based on the image information analysis result. Thereby, for a user who repeatedly performs printing according to a specific layout, an image forming apparatus, that can reduce power consumption with implementing high image quality, can be provided.

Modification

Image information handled in Embodiment 2 is Maxink values, but image information is not limited to this. For example, the correction temperature may be determined depending on whether the image is constituted of text alone. The correction temperature may be set to −10° C. if the image is constituted of text alone, or to 0° C. if not. Further, instead of the maximum value of the toner amount conversion value, an average value (Averageink) or the like may be used. Further, the correction temperatures of the target temperatures based on the Maxink values are set, as indicated in Table 7, but the correction temperatures are not limited to these temperatures. In Embodiment 2, the number of pages stored in the operation history collection unit 506 is not limited to 200, but may be an any number. Further, in S801, in the frequency distribution of the number of printed pages with Maxink values, the temperature control unit 505 accumulates the number of printed pages in sequence from the lower Maxink value, and determines the range of the Maxink values when the accumulated number of printed pages exceeds 160 pages, that is, 80% of the total is determined in S801, but this ratio is not limited to 80%.

Furthermore, in Embodiment 2, the estimated Maxink values are analyzed by the frequency distribution of the number of printed pages, as indicated in Table 9, but the embodiments of the present invention are not limited to this.

Further, in Embodiment 2, a case where the letter size plain paper is printed with Maxink 100% in the heat generating blocks HB3 to HB5 and with Maxink 0% in the heat generating blocks HB1, 2, 6 and 7 was described as an example, but an arbitrary size, any print mode and any Maxink may be used.

Further, in Embodiment 2, if 200 pages of operation history with Maxink value is not stored, the target temperatures are not corrected with the estimated Maxink value, but the embodiments of the present invention are not limited to this, and the estimated Maxink value may be a predetermined arbitrary value. For example, if the estimated Maxink value is 0%, the target temperatures of the heat generating blocks HB1 to HB7 can be set to 250° C., and the power consumption can be further decreased. If the image density is then determined and the specified Maxink values of the heat generating blocks HB1 to HB7 are different from the estimation, the operation period of the pre-rotation sequence is changed, so that the heat generating blocks HB1 to HB7 reach the image forming target temperatures before the recording material enters the fixing nip portion N, just like Embodiment 2.

Embodiment 3

In Embodiment 3, an example of changing the heating amounts of the non-sheet passing blocks based on the print reserve information of the print operation history, in the case where a new print reservation is added in a succeeding step, will be described. The configurations of the image forming apparatus, image heating apparatus, heater, heater control circuit and control blocks are the same as FIGS. 1 to 4 of Embodiment 1. The flow chart of the pre-heating sequence is the same as FIG. 5 of Embodiment 1. Aspects that are not especially described in Embodiment 3 are the same as Embodiment 1.

Control Flow Chart of Pre-Rotation Sequence in Embodiment 3

Figure 15:
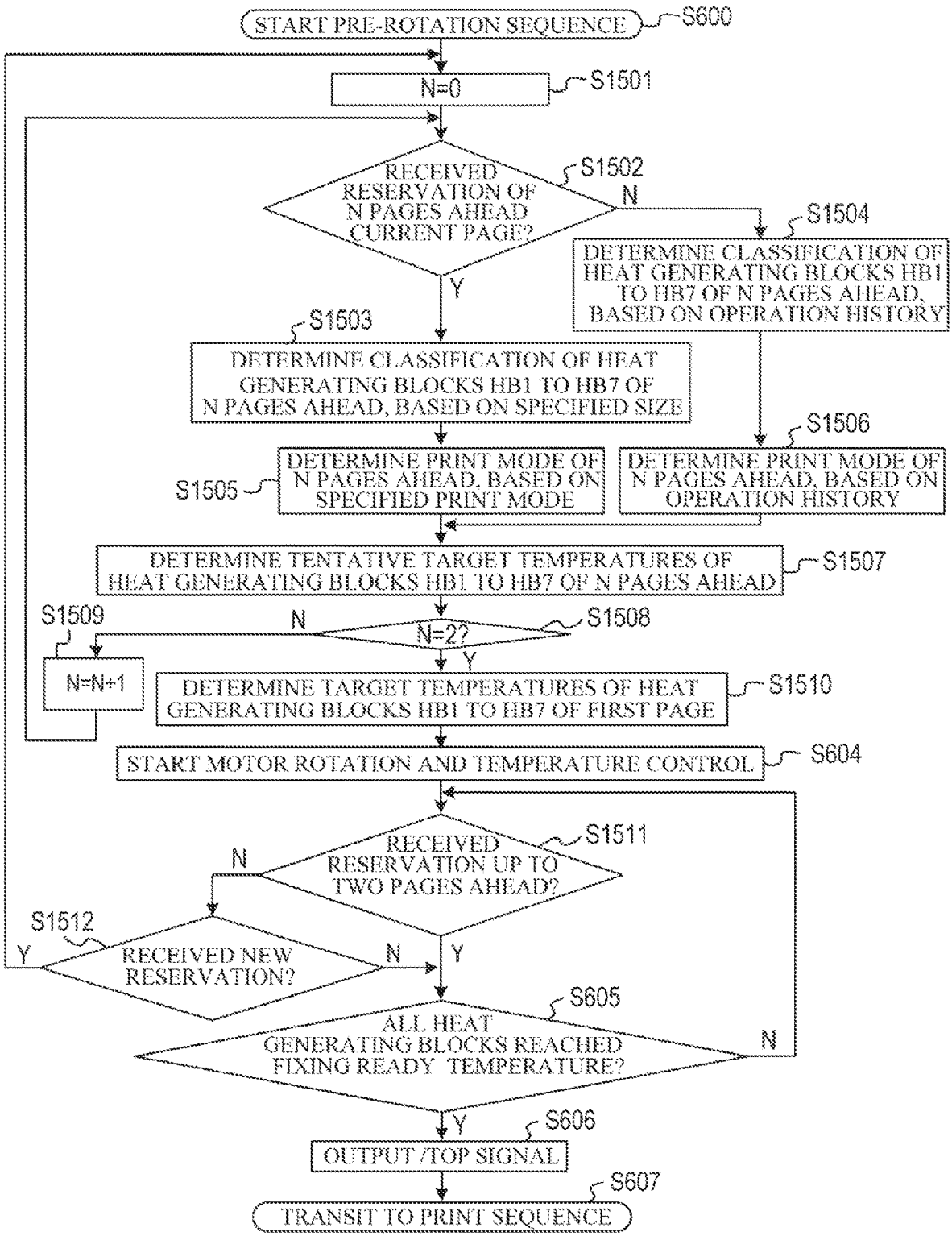
FIG. 15 is a control flow chart of a pre-rotation sequence according to Embodiment 3.

FIG. 15 is a control flow chart of the pre-rotation sequence of Embodiment 3. When the pre-rotation sequence starts in S600, the temperature control unit 505 sets a variable N stored in the RAM 469 to 0 in S1501. The variable N=0 indicates the page that is 0 page(s) ahead of the current page (the current page itself), N=1 indicates the page that is one page ahead of the current page, and N=2 indicates the page that is two pages ahead of the current paper.

In S1502, it is determined whether the print reserve information of the recording material that is N pages ahead of the current page and the print start command were sent from the video controller 120 to the engine controller 113.

If it is determined in S1502 that the print reserve information of the recording material that is N pages ahead and the print start command were sent, processing advances to S1503. In S1503, the temperature control unit 505 classifies whether each heat generating block HB1 to HB7 of the recording material that is N pages ahead is a sheet passing block or a non-sheet passing block.

Then in S1505, the engine controller 113 sets the print mode of the recording material that is N pages ahead is the print mode specified in the print reserve information.

If it is determined in S1502 that the print reserve information of the recording material that is N pages ahead and the print start command were not sent, processing advances to S1504. In S1504, the temperature control unit 505 refers to the print reserve information analysis result computed by the operation history analysis unit 508, and determines, for each heat generating block HB1 to HB7 respectively, the ratio when a heat generating block is the non-sheet passing block in the operation history. For a heat generating block of which ratio, when a heat generating block is the non-sheet passing block in the most recent 200 pages of the operation history, is at least 80%, it is estimated that this block is likely to be the non-sheet passing block in the recording material that is N pages ahead. For a heat generating block of which this ratio is less than 80%, or for a heat generating block of which the 200 pages of operation history is not recorded in the operation history collection unit 506, it is estimated that this heat generating block in the recording material that is N pages ahead is more likely to be the sheet passing block.

Then in S1506, the engine controller 113 refers to the number of printed pages for each mode in the print reserve information analysis result, and estimates that a mode of which ratio is at least 80% in the print modes of the most recent 200 pages is the print mode of the recording material that is N pages ahead. If there is no mode of which ratio is at least 80%, or 200 pages of operation history is not stored in the operation history collection unit 506, it is estimated that the print mode of the recording material that is N pages ahead is more likely to be the thick paper mode, in which the target temperature of the sheet passing block becomes the highest.

In S1507, tentative target temperatures of the heat generating blocks HB1 to HB7 in the recording material that is N pages ahead in the pre-rotation sequence are set based on the estimation result. The tentative target temperature of the sheet passing block is set to a target temperature (target temperature of the sheet passing block in the print sequence) that is required to fix the toner image to the recording material. The tentative target temperature of the non-sheet passing block is set to a minimum target temperature (target temperature of the non-sheet passing block in the print sequence) in order to reduce power consumption. The values of target temperature of the sheet passing block in the print sequence and the target temperature of the non-sheet passing block in the print sequence are indicated in Table 6.

In S1508, it is determined whether the variable N is currently set to 2. If not set to 2, the variable N is set to N+1 (S1509), and processing returns to S1502. If set to 2, processing advances to S1510, and the target temperatures of the heat generating blocks HB1 to HB7 of the first page of the recording material are determined.

In S1510, the target temperatures of the first page of the recording material are set so that the temperatures of the heat generating blocks are increased to the tentative target temperatures of the succeeding sheet before the succeeding paper is conveyed to the fixing nip portion N. The target temperature of each heat generating block of the first page of the recording material is set to the highest temperature among the tentative target temperatures of the heat generating blocks in the first to third pages. This processing is performed for the heat generating blocks HB1 to HB7, and the target temperatures of the heat generating blocks HB1 to HB7 of the first page of the recording material are computed. S604 follows that in Embodiment 1 (FIG. 7).

In S1511, it is determined whether the print reserve information on the recording material that is two pages ahead and the print start command were sent from the video controller 120 to the engine controller 113. Processing advances to S1512 if not sent, or to S605 if sent.

In S1512, it is determined whether the new print reserve information and the print start command were sent from the video controller 120 to the engine controller 113. If sent, processing returns to S1501 and the target temperatures of the first page are set again. If not sent, processing advances to S605.

S605 to S607 are the same as Embodiment 1 (FIG. 7).

Flow Chart of Print Sequence in Embodiment 3

Figure 16:
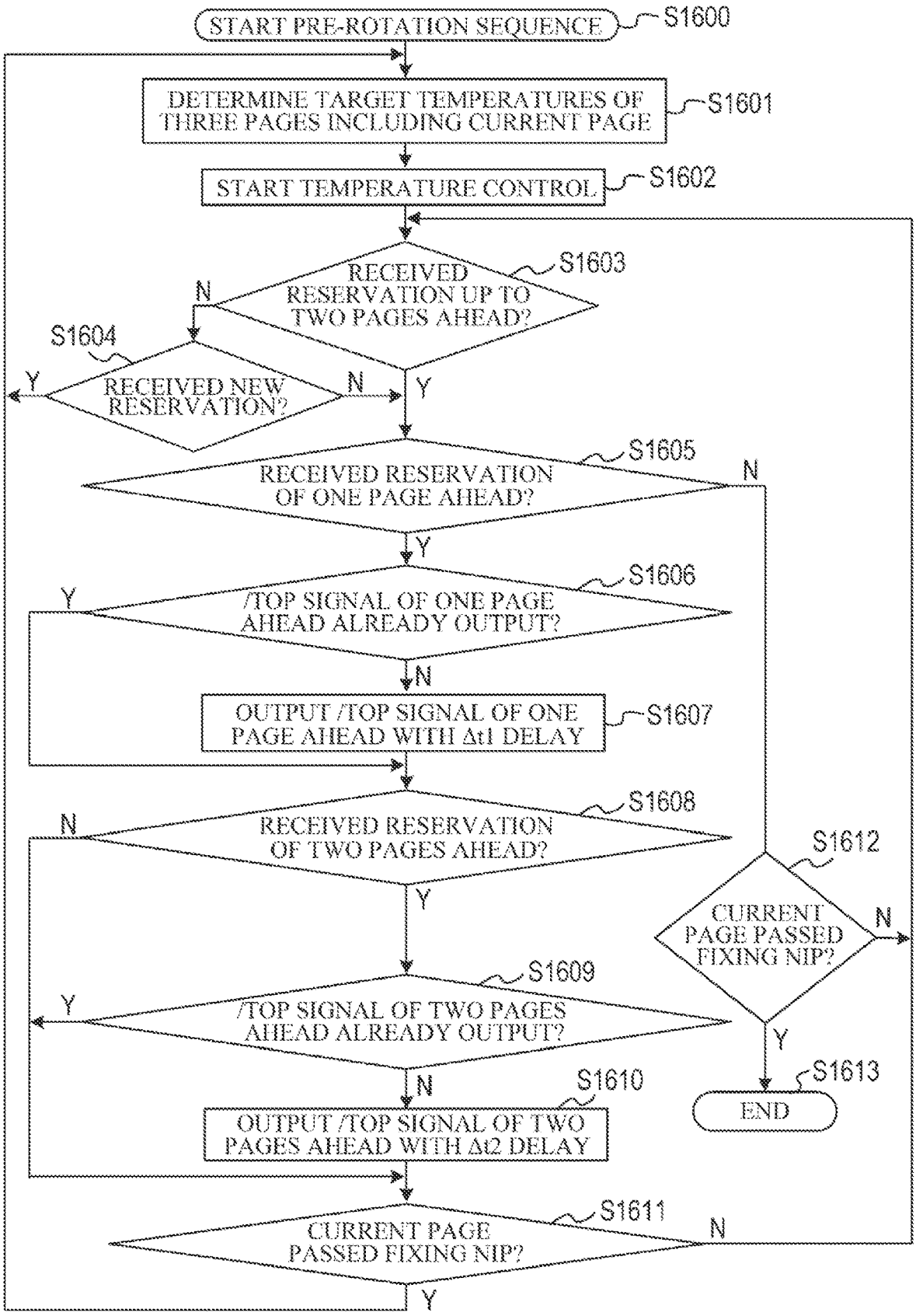
FIG. 16 is a control flow chart of a print sequence according to Embodiment 3.

FIG. 16 is a control flow chart of the print sequence in Embodiment 3.

When the print sequence starts in S1600, the target temperatures of three pages, including the current page, are set in the same way as the procedures in S1501 to S1510 described with reference to FIG. 15 in S1601.

In S1603, it is determined whether the print reserve information on the recording material that is two pages ahead and the print start command were sent from the video controller 120 to the engine controller 113. Processing advances to S1604 if not sent, or to S1605 if sent.

In S1604, it is determined whether the new print reserve information and print start command were sent from the video controller 120 to the engine controller 113. If sent, processing returns to S1601, and the target temperatures of three pages, including the current page, are sent again. If not sent, processing advances to S1605.

In S1605, it is determined whether the print reserve information on the recording material that is one page ahead of the current page and the print start command were sent from the video controller 120 to the engine controller 113. Processing advances to S1606 if sent, or to S1612 if not sent.

In S1606, it is determined whether the/TOP signal of the recording material that is one page ahead of the current page is outputted. Processing advances to S1607 if not outputted, or to S1608 if outputted.

In S1607, the/TOP signal of the recording material that is one page ahead of the current page is outputted at a delayed timing by delay time Δt1 compared with the case of the fastest output, and processing advances to S1608. Δt1 is computed using Expression 4.

$$\Delta t1=(TtgtC1-TtgtC0)/\Delta Tk \quad \text{(Expression4)}$$

TtgtC1 is the target temperature of the recording material that is one page ahead of the current page, and TtgtC0 is the target temperature of the current page. If TtgtC1 and TtgtC0 are the same temperature, Δt1 becomes 0, and the/TOP signal is outputted at the fastest timing. ΔTk is a value that is set in advance, and is a temperature increase value per unit time in each heating block, in the state where the recording material P is not held and conveyed in the fixing nip portion N. In Embodiment 3, ΔTk is 30° C. (common to all heat generating blocks).

In S1608, it is determined whether the print reserve information on the recording material that is two pages ahead of the current page and the print start command were sent from the video controller 120 to the engine controller 113. Processing advances to S1609 if sent, or to S1611 if not sent.

In S1609, it is determined whether the/TOP signal of the recording material that is two pages ahead of the current page is outputted. Processing advances to S1610 if not outputted, or to S1611 if outputted.

In S1610, the/TOP signal of the recording material that is two pages ahead of the current page is outputted at a delayed timing by delay time Δt2 compared with the case of the fastest output, and processing advances to S1611. Δt2 is computed using Expression 5.

$$\Delta t2=(TtgtC2-TtgtC0)/\Delta Tk \quad \text{(Expression 5)}$$

TgtC2 is the target temperature of the recording material that is two pages ahead of the current page.

In S1611, it is determined if the current page has passed through the fixing nip portion N. Processing advances to S1903 if the current page has not yet passed through. If the current page has passed through, processing advances to S1601, the image heating operation of the next recording material starts, and processing is performed by the same flow as FIG. 18.

In S1612, it is determined if the current page has passed through the fixing nip portion N. Processing advances to S1903 if the current page has not yet passed through. If the current page has passed through, processing advances to S1613, and image processing ends.

Transition Example of Heating Generating Block Temperature in Embodiment 3

In Embodiment 3, the history of the most recent 200 pages of the print reserve information is stored in the operation history collection unit 506, and the print reserve information analysis result computed by the operation history analysis unit 508 is as indicated in Tables 3 and 4. A transition example of the heat generating block temperatures, in the case where printing is performed in this state, will be described.

Figure 17:
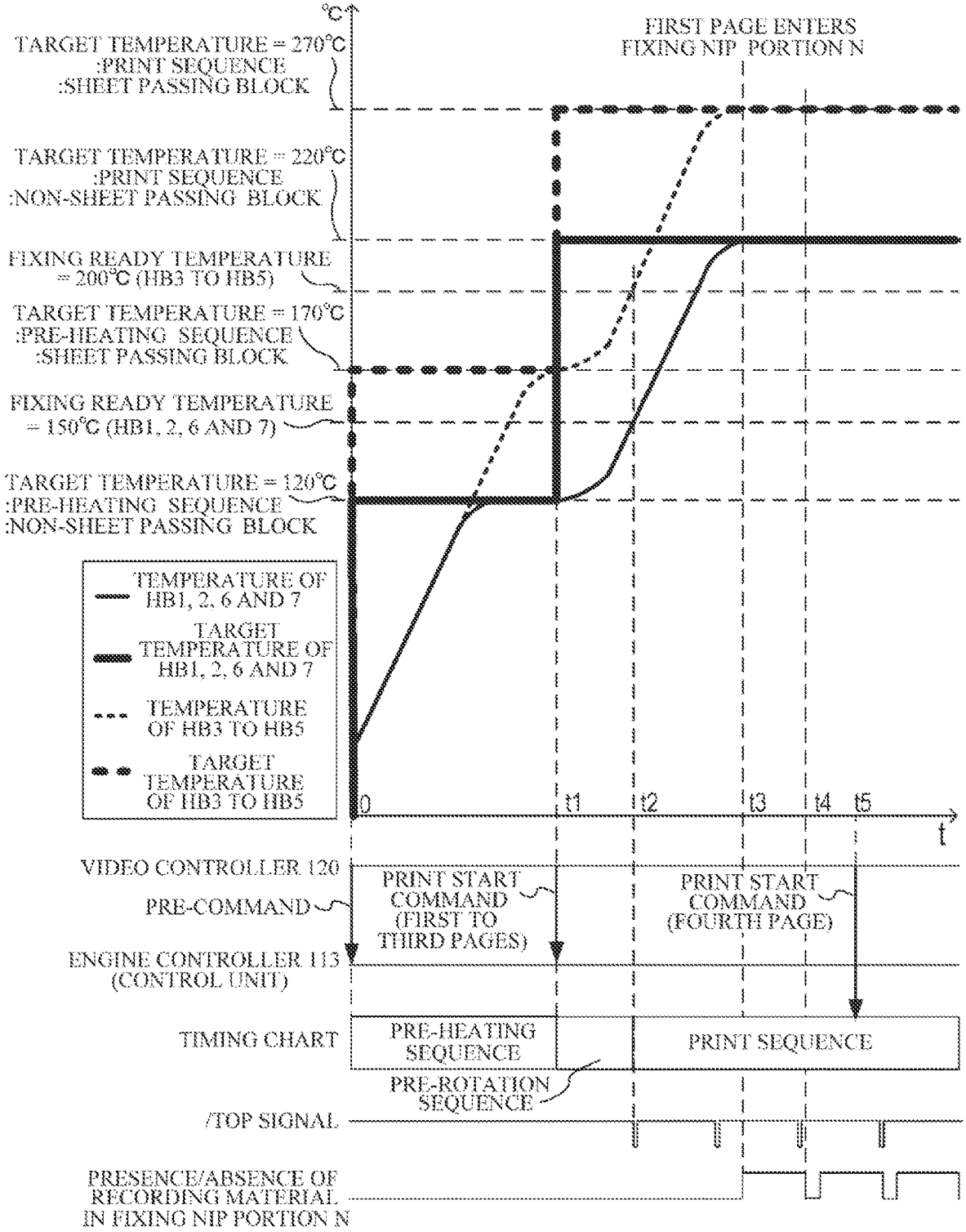
FIG. 17 is a diagram depicting a temperature transition of heat generating blocks HB1 to HB7 according to Embodiment 3.

FIG. 17 indicates a case of printing three pages of B5 size plain paper, where the engine controller 113 additionally received the print reserve information of one page of B5 size plain paper, and the print start command in the middle of the image heating operation of the second page of the recording material.

At time t=0, the video controller 120 sends the pre-command to the engine controller 113.

Hereafter the heat generating member control unit 507 controls the temperatures of the heat generating blocks HB1 to HB7 in the same procedures as Embodiments 1 and 2, in accordance with the target temperatures that are set. The steps of setting the target temperatures are the same as Embodiment 1, therefore description thereof will be omitted.

When the print reserve information for the three pages and the print start command from the video controller 120 are received at t=t1 (Y in S506), the image forming control unit 502 instructs the temperature control unit 505 to perform temperature control in accordance with the control flow chart in FIG. 15.

Since the recording material sizes specified for the first to third pages are B5, it is determined in S1503, based on Table 1, that the heat generating blocks HB3 to HB5 of the first to third pages are the sheet passing blocks, and the heat generating blocks HB1, 2, 6 and 7 thereof are the non-sheet passing blocks. Further, since the print mode specified for the first to third pages is the plain paper mode in S1505, the temperature control unit 505 sets, in S1507, the image forming tentative target temperatures of the heat generating blocks HB3 to HB5 of the first to third pages to 270° C. respectively based on Table 6. The temperature control unit 505 also sets the tentative target temperatures of the heat generating blocks HB1, 2, 6 and 7 to 220° C. respectively. As described above, the maximum value of the tentative target temperatures of the first to third pages is set for the target temperature of the first page, hence in S1510, the target temperatures of the heat generating blocks HB3 to HB5 of the first page are set to 270° C. The target temperatures of the heat generating blocks HB1, 2, 6 and 7 thereof are set to 220° C. The heat generating member control unit 507 controls the temperatures of the heat generating blocks HB1 to HB7 in accordance with the target temperatures that are set.

When all the heat generating blocks HB1 to HB7 reach the fixing ready temperatures in S605, the image forming control unit 502 outputs the/TOP signal of the first page to the video controller 120 in S606 (t=t2).

After the print sequence in FIG. 16 starts and the heat generating blocks HB1 to HB7 reach the image forming target temperatures, the first page of the recording material enters the fixing nip portion N (t=t3), and is held and conveyed, whereby the unfixed toner image is fixed (S1611).

Then, at time t=t4, the image forming control unit 502 instructs the temperature control unit 505 to perform temperature control for the second page of the recording material in accordance with the flow in S1601. Since the specified sizes of the second and third pages are B5 in FIG. 17, the temperature control unit 505 determines, based on Table 1, that the heat generating blocks HB3 to HB5 of the second and third pages (N=0, 1) are the sheet passing blocks, and the heat generating blocks HB1, 2, 6 and 7 thereof are the non-sheet passing blocks (S1503).

The print start command for the fourth page (N=2) is not yet received at this point, but in Embodiment 3, the target temperatures are set based on the assumption that an image will be formed on the fourth page as well.

As mentioned above, based on the most recent 200 pages of the print reserve information analysis result, it is estimated, for the fourth page as well, that the heat generating blocks HB3 to HB5 are the sheet passing blocks, and the heat generating blocks HB1, 2, 6 and 7 are the non-sheet passing blocks, and the print mode is the plain paper mode.

Based on the control flow chart in FIG. 16, the temperature control unit 505 sets the image forming tentative target temperatures of the heat generating blocks HB3 to HB5 on the second to fourth pages (N=0 to 2) to 270° C. respectively (S1507). Further, the temperature control unit 505 sets the tentative target temperatures of the heat generating blocks HB1, 2, 6 and 7 to 220° C. respectively (S1507). The target temperature of the current page (second page) is the maximum value of the tentative target temperatures of the second to fourth images, hence in S1510, the target temperatures of the heat generating blocks HB3 to HB5 of the current page are set to 270° C., and the target temperatures of the heat generating blocks HB1, 2, 6 and 7 thereof are set to 220° C. The heat generating member control unit 507 controls the temperatures of the heat generating blocks HB1 to HB7 in accordance with the target temperatures that are set.

Then while the second page is held and conveyed in the fixing nip portion N (time t=t5), the engine controller 113 additionally receives the print reserve information on one page (fourth page) of the B5 size plain paper and the print start command. At this time, in the flow in FIG. 19, processing advances in the order of S1611, S1603, S1604 and S1601. Since the specified size of the fourth page is B5, the temperature control unit 505 sets the image forming tentative target temperature of the heat generating blocks HB3 to HB5 of the second to fourth pages to 270° C. respectively, and sets the tentative target temperatures of the heat generating blocks HB1, 2, 6 and 7 to 220° C. respectively, just like the case of the first to third pages.

The target temperature of the current page (second page) is the maximum value of the tentative target temperatures of the second to fourth pages, hence the target temperatures of the heat generating blocks HB3 to HB5 of the current page are set to 270° C., and the target temperatures of the heat generating blocks HB1, 2, 6 and 7 thereof are set to 220° C.

The heat generating member control unit 507 controls the temperatures of the heat generating blocks HB1 to HB7 in accordance with the target temperatures that are set.

Control Flow Chart of Pre-Rotation Sequence in Comparative Example 3

As Comparative Example 3, a case of performing printing in a state of not storing the most recent 200 pages of operation history in the operation history collection unit 506 will be described. In Comparative Example 3, the operation in the pre-heating sequence is the same as Comparative Example 1.

Figure 18:
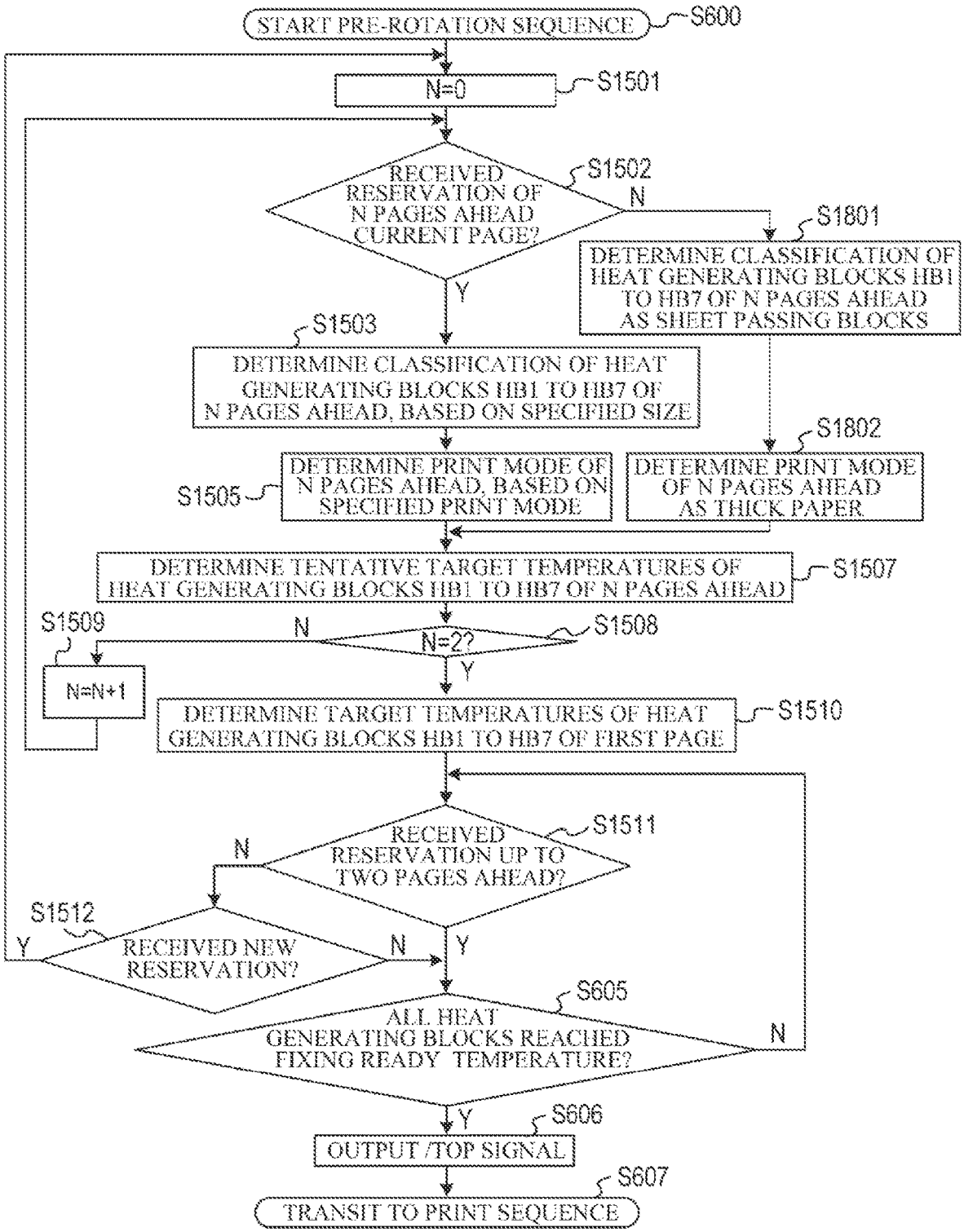
FIG. 18 is a control flow chart of a pre-rotation sequence according to Comparative Example 3.

FIG. 18 is a control flow chart of the pre-rotation sequence of Comparative Example 3.

S600, S1501 and S1502 are the same as Embodiment 3 (FIG. 15).

If the print reserve information of the recording material that is N pages ahead and the print start command were sent in S1802, processing advances to S1503. S1503 and S1505 are the same as Embodiment 3 (FIG. 15).

If the print reserve information of the recording material that is N pages ahead and the print start command were not sent in S1502, processing advances to S1801. In S1801, the temperature control unit 505 estimates that the heat generating blocks HB1 to HB7 of the recording material that is N pages ahead are likely to be the sheet passing blocks.

Then in S1802, the engine controller 113 estimates that the print mode of the recording material that is N pages ahead is more likely to be the thick paper mode in which the target temperature of the sheet passing block becomes the highest.

S1507 to S1512 and S605 to S607 are the same as Embodiment 3 (FIG. 15).

Flow Chart of Print Sequence in Comparative Example 3

The control flow chart of the print sequence in Comparative Example 3 will be described with reference to FIG. 16. The sequence, except for S1601, is the same as FIG. 16 (Embodiment 3), hence description thereof will be omitted.

In S1601, the target temperatures of three pages, including the current page, are set in the same procedure as S1501 to S1503, S1801, S1802 and S1507 to S1510 described in FIG. 18.

Transition Example of Heating Generating Block Temperature in Comparative Example 3

Figure 19:
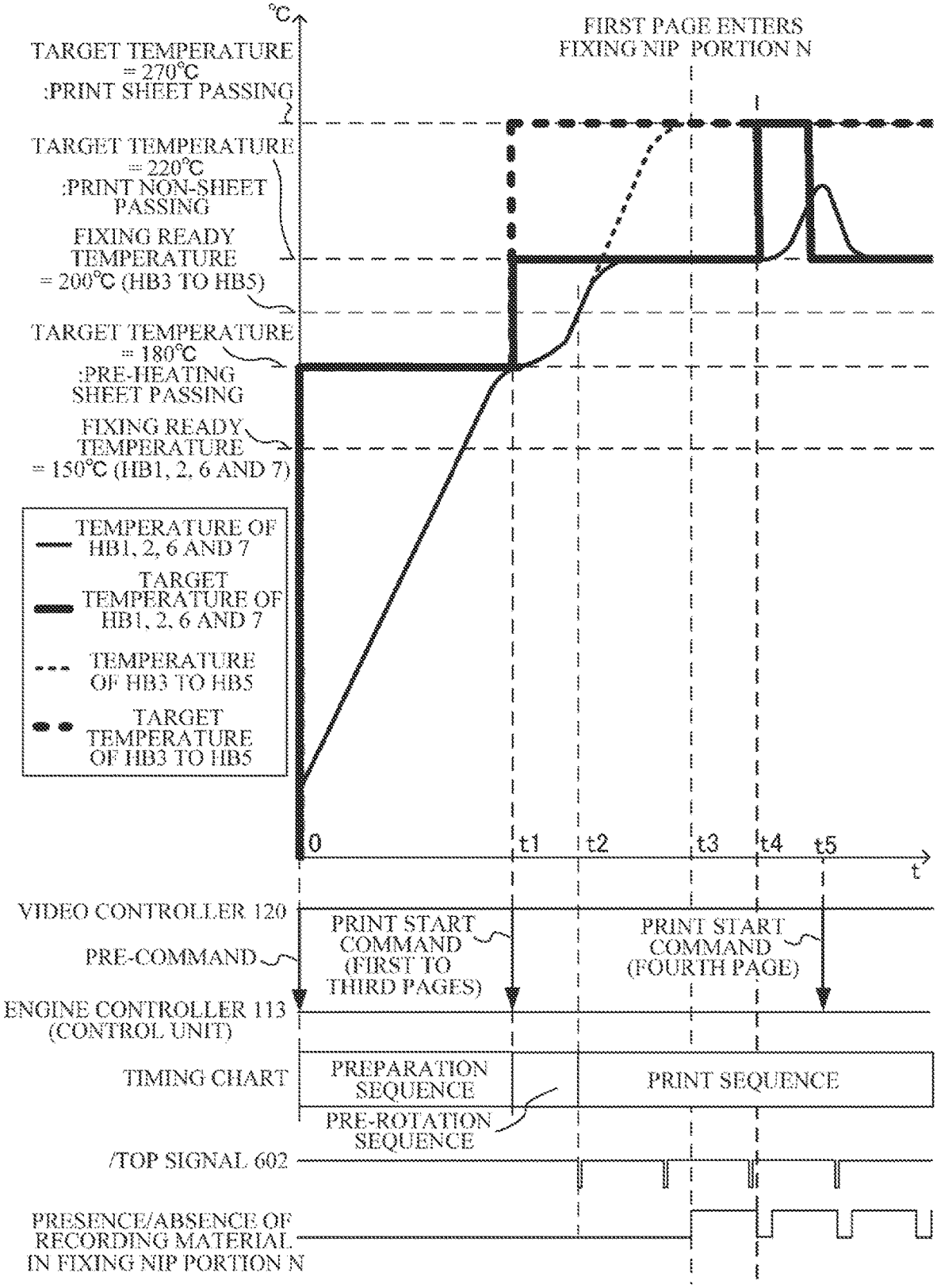
FIG. 19 is a diagram depicting a temperature transition of heat generating blocks HB1 to HB7 according to Comparative Example 3.

FIG. 19 is a transition example of the heat generating block temperatures in Comparative Examples 3 in the case where printing is performed in the same manner as Embodiment 3 (FIG. 17). In other words, FIG. 19 indicates the transition of the heat generating block temperatures in the case where three pages of B5 size plain paper are continuously printed, and the engine controller 113 additionally received one page of print reserve information on B5 size plain paper and the print start command in the middle of the image heating operation of the second page of the recording material.

At time t=0, the video controller 120 sends the pre-command to the engine controller 113.

Hereafter the pre-heating sequence is performed in the same manner as Comparative Example 1, and based on S800, the target temperatures of the heat generating blocks HB1 to HB7 in the pre-heating sequence are set to the target temperature 180° C. of the sheet passing block in the pre-heating sequence for the thick paper.

Then at t=t1, the video controller 120 instructs the print reserve information on the first to third pages of the recording material and the print start command to the engine controller 113. Based on the control flow chart in FIG. 18, the image forming control unit 502 sets the target temperatures of the heat generating blocks HB3 to HB5 of the first page to 270° C., and sets the target temperatures of the heat generating blocks HB1, 2, 6 and 7 to 220° C., and performs the temperature control (S1507).

When all the heat generating blocks HB1 to HB7 reach the fixing ready temperatures, the image forming control unit 502 outputs the/TOP signal of the first page to the video controller 120 in S606 (t=t2).

After the print sequence in FIG. 16 is started and the heat generating blocks HB1 to HB7 reach the image forming target temperatures, the first page of the recording material enters the fixing nip portion N (t=t3), and is held and conveyed, whereby the unfixed image is fixed (S1611).

Then at time t=t4, the image forming control unit 502 instructs the temperature control unit 505 to perform the temperature control of the second page of the recording material.

The print start command for the fourth page is not yet received at this point, hence in Comparative Example 3, it is estimated that the heat generating blocks HB1 to HB7 are likely to be the sheet passing blocks on the fourth page. It is also estimated that the print mode of the fourth page is likely to be the thick paper mode.

Based on the control flow chart in FIG. 16, the temperature control unit 505 sets the image forming tentative target temperatures of the heat generating blocks HB1 to HB7 of the second to fourth pages to 280° C. respectively. The target temperature of the current page (second page) is the maximum value of the tentative target temperatures of the second to fourth images, hence the target temperatures of the heat generating blocks HB1 to HB7 of the current page are set to 270° C. The heat generating member control unit 507 controls the temperatures of the heat generating blocks HB1 to HB7 in accordance with the target temperatures that are set.

Then while the second page is held and conveyed in the fixing nip portion N (time t=t5), the engine controller 113 additionally receives the print reserve information on one page (fourth page) of the B5 size plain paper and the print start command. Since the specified size of the fourth page is B5, the temperature control unit 505 determines that the heat generating blocks HB3 to HB5 of the fourth page are the sheet passing blocks, and the heat generating blocks HB1, 2, 6 and 7 thereof are the non-sheet passing blocks based on Table 1. Since the specified print mode is the plain paper mode, the temperature control unit 505 sets the image forming tentative target temperatures of the heat generating blocks HB3 to HB5 of the second to fourth pages to 270° C. respectively, and sets the tentative target temperatures of the heat generating blocks HB1, 2, 6 and 7 to 220° C. respectively based on Table 6.

The target temperature of the current page (second page) is the maximum value of the tentative target temperatures of the second to fourth pages, hence the target temperatures of the heat generating blocks HB3 to HB5 of the current page are set to 270° C., and the target temperatures of the heat generating blocks HB1, 2, 6 and 7 thereof are set to 220° C. The heat generating member control unit 507 controls the temperatures of the heat generating blocks HB1 to HB7 in accordance with the target temperatures that are set.

Transition Example When Estimated Size and Specified Size are Different in Embodiment 3

A case where the classification of heat generating blocks and print mode estimated from the print reserve information analysis result are different from the classification of the heat generating blocks and print mode determined based on the print reserve information on the fourth page in Embodiment 3 will be described. In this case, output of the/TOP signal of the fourth page is delayed by the delay time Δt2 in S1610, so that the heat generating blocks HB1 to HB7 reach the target temperatures before the fourth page of the recording material enters the fixing nip portion N.

Figure 20:
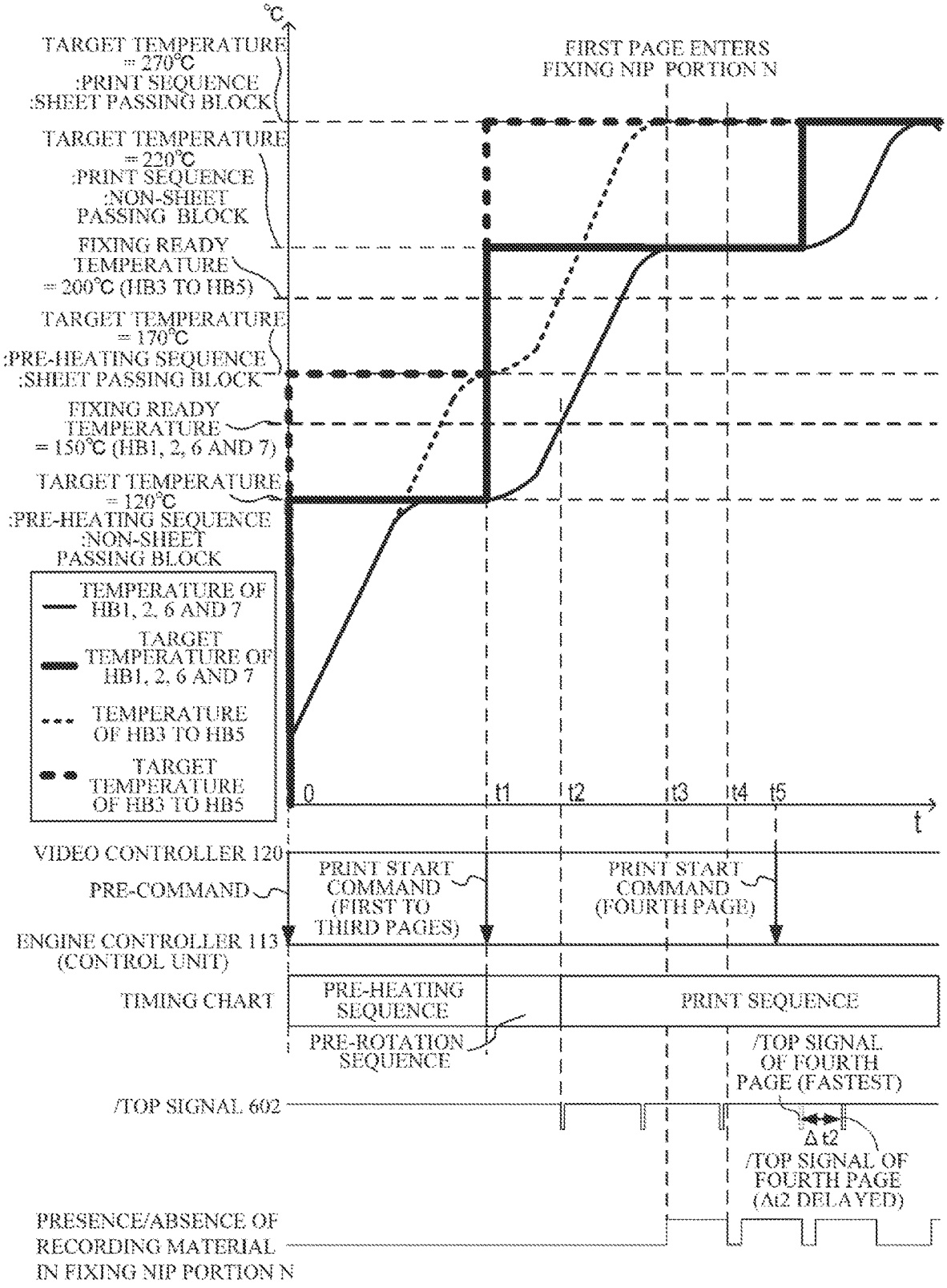
FIG. 20 is a diagram depicting a temperature transition of heat generating blocks HB1 to HB7 in the case where an estimated size and a specified size are different according to Embodiment 3.

FIG. 20 is an example when the classification of the heat generating blocks estimated based on the print reserve information analysis result is different from the classification of the heat generating blocks determined based on the print reserve information. As an example when the estimation size and the specified size are different, FIG. 20 indicates a case where the B5 size plain paper printing is performed on the first to third pages, and the letter size plain paper printing is performed on the fourth page. FIG. 20 is a transition example in this case, where the temperatures of the heat generating blocks HB1 to HB7, timing chart, /TOP signal and presence/absence of a recording material in the fixing nip portion N are indicated. The print reserve information analysis result is the same as FIG. 17. The operation of the period from the pre-command to the print start command for the fourth page is the same as FIG. 17, but the operation thereafter is different from FIG. 17.

At the point when the print start command for the fourth page is received, it is determined that the specified size of the fourth page is the letter size (t=t5). At this time, the temperature control unit 505 determines that the heat generating blocks HB1 to HB7 on the fourth page are the sheet passing blocks based on Table 1. Since the print mode is the plain paper mode, the temperature control unit 505 sets the tentative target temperatures of the heat generating blocks HB1 to HB7 of the fourth page to 270° C.

The target temperature of the current page (second page) is the maximum value of the tentative target temperatures of the second to fourth pages, hence the target temperatures of the heat generating blocks HB1 to HB7 of the current page are set to 270° C. The heat generating member control unit 507 controls the temperatures of the heat generating blocks HB1 to HB7 in accordance with the target temperatures that are set.

The engine controller 113 outputs the/TOP signal of the fourth page at a delayed timing by the delay time Δt2 (=1.3 seconds) computed using Expression 5, compared with the case of the fastest output. In other words, the engine controller 113 (conveying control portion) increases (extends) the conveying interval between the preceding recording material and the succeeding recording material.

Effect

In Embodiment 3, in the period when the second page is passing the recording material fixing nip portion N, the target temperatures of the heat generating blocks HB1, 2, 6 and 7 before receiving the print start command for the fourth page, are set to 220° C., which is lower than the target temperature 270° C. in Comparative Example 3 by 50° C. Thereby the power required to reach the target temperatures can be reduced, and the power required to maintain the target temperature can also be reduced depending on the length of the delay time of the print start command compared with the comparative example.

As described above, according to Embodiment 3, in the case where the print reserve information on the succeeding sheet is not determined, the print reserve information on the succeeding sheet is estimated based on the print reserve information analysis result. Compared with the case of estimating that the paper size of the succeeding sheet is the maximum sheet passing width (Comparative Example 3), the heating amount of the non-sheet passing block in the print sequence can be decreased. Thereby, to the user who regularly prints small size paper, an image forming apparatus that can reduce power consumption with implementing high image quality can be provided.

Modification

In Embodiment 3, the print reserve information analysis results are set as in Tables 3 and 4, but are not limited to this. Further, in Embodiment 3, the target temperatures are set as in Table 5 and 6, but are not limited to these temperatures.

Further, in Embodiment 3, the target temperatures of the non-sheet passing blocks in the pre-rotation sequence and print sequence are determined by referring to the target temperature of the non-sheet passing block in the print sequence of Table 6, but are not limited to this. For example, the target temperature TPtgtnp of the non-sheet passing block may be computed using Expression 6, where the ratio of the non-sheet passing blocks is x %.

$$TPtgtnp=(x\times TPnp+(100-x)\times TPp)/100 \quad \text{(Expression 6)}$$

Here TPnp is the target temperature of the non-sheet passing block in the print sequence determined by referring to Table 6, and TPp is the target temperature of the sheet passing block in the print sequence determined by referring to Table 6.

Further, in Embodiment 3, the number of pages stored in the operation history collection unit 506 is not limited to 200, and may be an any number. The ratio (frequency) of various information which the temperature control unit 505 uses as a determination standard in S502 is not limited to a specific value, but may be set in accordance with the specifications of the apparatus, for example. In other words, 80% is used as a ratio of the non-sheet passing blocks to determine whether each heat generating block HB1 to HB7 is the non-sheet passing block or the sheet passing block, or as a ratio to determine the print mode based on the print reserve information analysis result in the pre-heating sequence, but the ratios are not limited to these.

Further, in Embodiment 3, a case of additionally printing B5 size plain paper for the fourth page was described as an example, but any size or any print mode may be used. The additionally printed page is not limited to the fourth page, but may be an any page.

Further, in Embodiment 3, if the 200 pages of operation history of the print related information is not stored, it is estimated that the print mode is the thick paper mode, and the heat generating blocks HB1 to HB7 are all the sheet passing blocks. But the embodiments of the present invention are not limited to this, and the print mode may be estimated as the plain paper mode or the thin paper mode, and the heat generating blocks HB1 to HB7 may be estimated to be the non-sheet passing blocks. For example, if the print mode is estimated as the plain paper mode and the heat generating blocks HB1, 2 6 and 7 are estimated as the non-sheet passing blocks, the target temperatures of the heat generating blocks HB1, 2, 6 and 7 in the pre-rotation sequence and print sequence can be decreased to 220° C., even if the 200 pages of operation history is not stored, and power consumption can be further reduced. If the print reserve information is then determined and the classification of the heat generating blocks HB1 to HB7 turns out to be different from what was estimated, the conveying interval between the preceding recording material and the succeeding recording material is increased (extended), just like Embodiment 3.

Embodiment 4

In Embodiment 4, an example of changing the heating amounts of the heat generating blocks HB1 to HB7 based on the history of the image information in the case where the acquisition of the image data on the succeeding sheet delays in the print sequence, and the image information is not determined since there is insufficient time to compute the image information, will be described. The configurations of the image forming apparatus, image heating apparatus, heater and control blocks are the same as FIGS. 1 to 4 in Embodiment 1. The flow chart of the pre-heating sequence is the same as Embodiment 2 (FIG. 11). Aspects that are not especially described in Embodiment 4 are the same as Embodiments 1 and 2.

Control Flow Chart of Pre-Rotation Sequence in Embodiment 4

Figure 21:
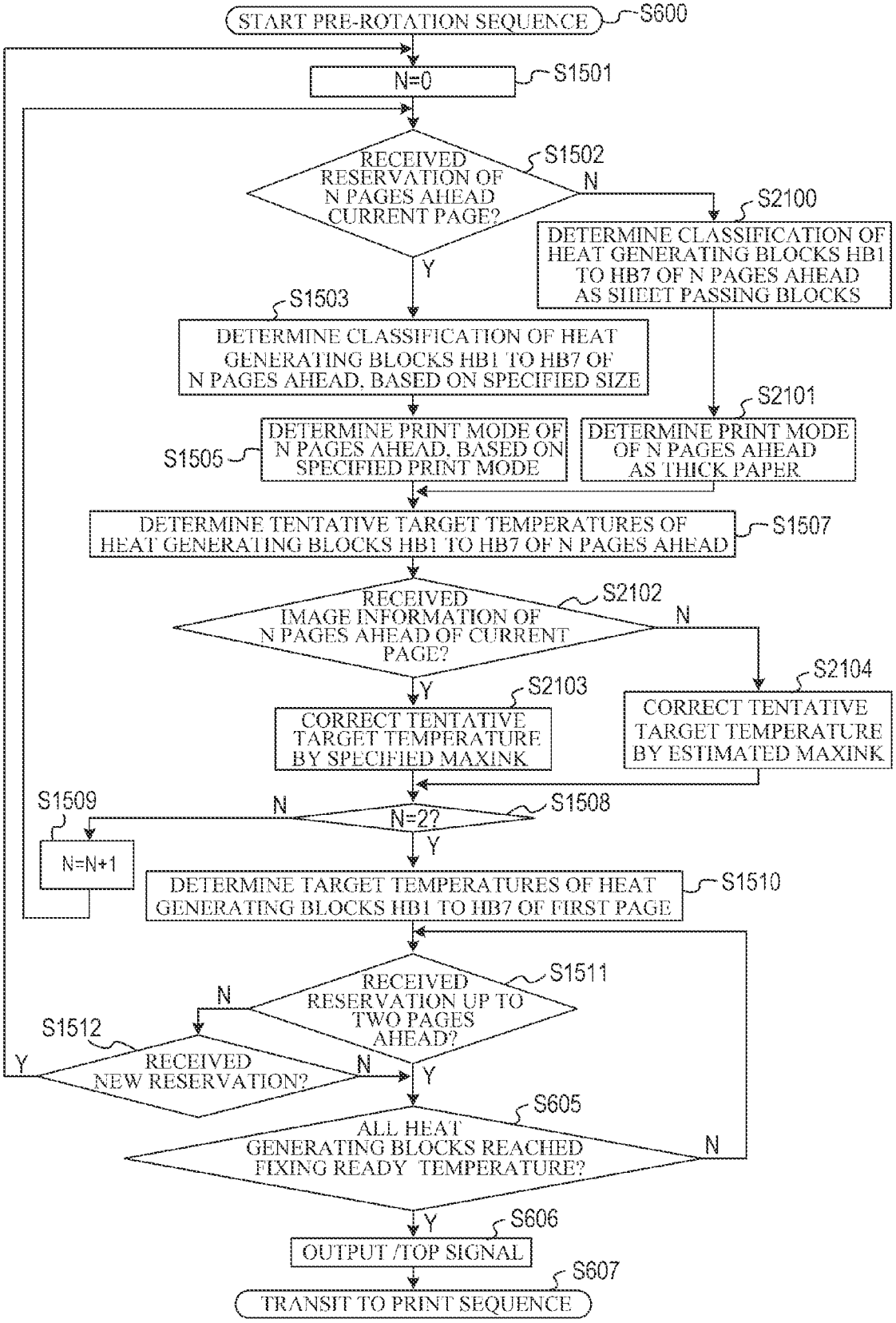
FIG. 21 is a control flow chart of a pre-rotation sequence according to Embodiment 4.

FIG. 21 is a control flow chart of the pre-rotation sequence of Embodiment 4.

S600, S1501 and S1502 are the same as Embodiment 3 (FIG. 15).

If it is determined in S1502 that the print reserve information of the recording material that is N pages ahead and the print start command were sent, processing advances to S1503. S1503 and S1505 are the same as Embodiment 3 (FIG. 15).

If it is determined in S1502 that the print reserve information on the recording material that is N pages ahead and the print start command were not sent, processing advances to S2100. In S2100, the temperature control unit 505 estimates and sets that the heat generating blocks HB1 to HB7 of the recording material that is N pages ahead are the sheet passing blocks.

Then in S2101, the engine controller 113 estimates and sets that the print mode of the recording material that is N pages ahead is the thick paper mode in which the target temperature of the sheet passing block is the highest.

S1507 is the same as Embodiment 3 (FIG. 15).

In S2102, it is determined whether the image information (specified Maxink values) of the heat generating blocks HB1 to HB7 of the recording material that is N pages ahead of the current page was computed by the video controller 120 and sent to the engine controller 113.

If it is determined in S2102 that the specified Maxink value of the recording material that is N pages ahead was sent, the temperature control unit 505 determines the correction temperature in S2103 based on the specified Maxink value that was sent and Table 7, and corrects the tentative target temperatures of the sheet passing blocks determined in S1507.

If it is determined in S2102 that the specified Maxink value of the recording material that is N pages ahead was not sent, processing advances to S2104. In S2104, the temperature control unit 505 determines the correction temperatures for the heat generating blocks HB1 to HB7, based on the image information analysis result (estimated Maxink values in the heat generating blocks HB1 to HB7) and Table 7, and corrects the tentative target temperatures of the sheet passing blocks of the recording material that is N pages ahead. If the 200 pages of the operation history is not stored in the operation history collection unit 506, correction of the tentative target temperatures of the sheet passing blocks of the recording material that is N pages ahead using the estimated Maxink values is not performed.

S1508 to S1812 and S604 to S607 are the same as Embodiment 3 (FIG. 15).

Flow Chart of Print Sequence in Embodiment 4

The control flow chart of the print sequence in Embodiment 4 will be described with reference to FIG. 16. Processing steps other than S1601 are the same as Embodiment 3 described with reference to FIG. 16, therefore description thereof will be omitted.

In S1601, the target temperatures for three pages, including the current page, are set in the same procedure as S1501 to S1503, S1505, S2100 to S2104 and S1507 to S1510 described in FIG. 21.

Transition Example of Heating Generating Block Temperature in Embodiment 4

In Embodiment 4, the history of the most recent 200 pages of the image information is stored in the operation history collection unit 506, and is analyzed by the operation history analysis unit 508, and this image information analysis result (estimated Maxink values) is indicated in Table 9. A transition example of the heat generating block temperatures, in the case where printing is performed in this state, will be described.

Figure 22:
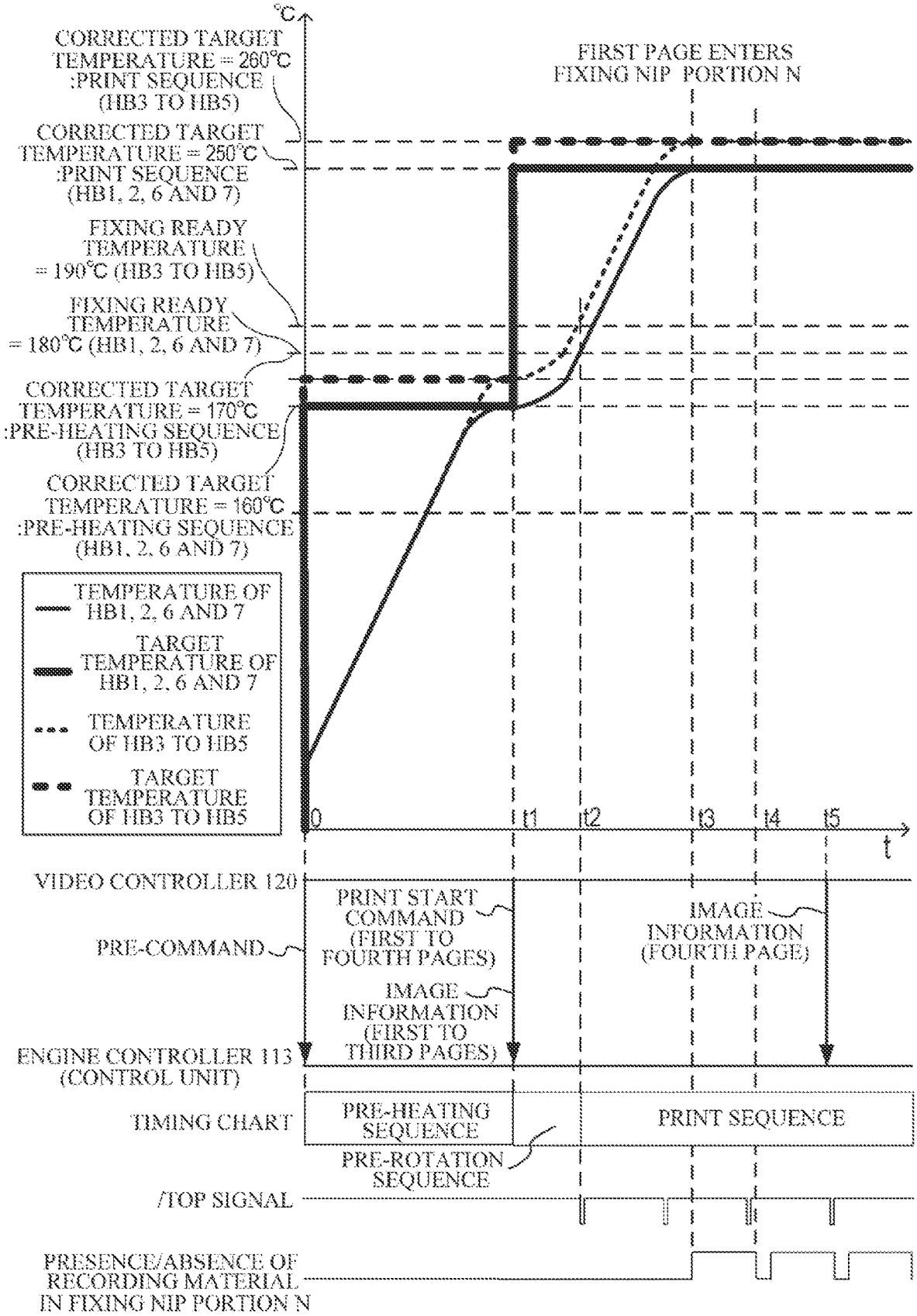
FIG. 22 is a diagram depicting a temperature transition of heat generating blocks HB1 to HB7 according to Embodiment 4.

FIG. 22 indicates a heat generating block temperature transition in the case of continuously printing four pages of letter size plain paper, where the engine controller 113 receives the image information on the fourth page, while the image heating operation is performed on the second page of the recording material. The image information is the same for all four pages, and the Maxink values of the heat generating blocks HB3 to HB5 are 120%, and the Maxink values of the heat generating blocks HB1, 2, 6 and 7 are 0%.

At time t=0, the video controller 120 sends the pre-command to the engine controller 113. Hereafter the processing steps are the same as Embodiment 2, and based on S1100 in FIG. 11, the target temperatures of the heat generating blocks HB1 to HB7 in the pre-heating sequence are set to the target temperature 180° C. of the sheet passing block in the pre-heating sequence for thick paper mode.

Just like Embodiment 2, the target temperatures of the heat generating blocks HB3 to HB5 in the pre-heating sequence are set to 170° C., and the target temperatures of the heat generating blocks HB1, 2, 6 and 7 are set to 160° C. based on the analysis information on the number of printed pages with the Maxink value for each heat generating block HB1 to HB7 in Table 9.

Then at time t=t1, the engine controller 113 receives the print reserve information on the first to fourth pages, the print start command and image information on the first to third pages (Y in S506). Then the image forming control unit 502 instructs the temperature control unit 505 to perform temperature control in accordance with the print mode and recording material size specified in the print reserve information and Maxink values specified in the image information. The first to third pages are processed according to the flow in FIG. 21, based on the same procedure as Embodiment 4.

Since the target temperature of the first page is the maximum value of the corrected tentative target temperatures of the first to third pages, the target temperatures of the heat generating blocks HB3 to HB5 of the first page are set to 260° C., and the target temperatures of the heat generating blocks HB1, 2, 6 and 7 are set to 250° C. (S1510).

The heat generating member control unit 507 controls the temperatures of the heat generating blocks HB1 to HB7 in accordance with the target temperatures that are set.

When the heat generating blocks HB1 to HB7 reach the fixing ready temperatures (S605), the image forming control unit 502 outputs the/TOP signal to the video controller 120 in S606 (t=t2).

After the heat generating blocks HB1 to HB7 reach the image forming target temperatures, the recording material on which the toner image is laid enters the fixing nip portion N in accordance with the flow in FIG. 16 (t=t3), and is held and conveyed, whereby the unfixed toner image is fixed (S1611).

Then at time t=t4, the image forming control unit 502 instructs the temperature control unit 505 to perform temperature control for the second page of the recording material. Since the specified sizes of the second to fourth pages are letter size, the temperature control unit 505 determines, based on Table 1, that the heat generating blocks HB1 to HB7 of the second to fourth pages are the sheet passing blocks. Further, since the print mode is the plain paper mode, the tentative target temperatures of the heat generating blocks HB1 to HB7 of the second to fourth pages are set to 270° C. respectively based on Table 6 (S1503, S1505).

At the point of t=t4, the image information on the fourth page (specified Maxink values) is not yet sent (N in S2102). Therefore in the correction temperatures are determined using the image information analysis result (estimated Maxink values). As mentioned above, based on the analysis result in Table 9, the estimated Maxink values in printing of the fourth page are set to 101 to 150%, and the corrected tentative target temperatures of the heat generating blocks HB3 to HB5 of the fourth page are set to 260° C. In the same manner, the corrected tentative target temperatures of the heat generating blocks HB1, 2, 6 and 7 of the fourth page are set to 250° C. (S2104).

Since the target temperature of the current page (second page) is the maximum value of the corrected tentative target temperatures of the second to fourth pages, the target temperatures of the heat generating blocks HB3 to HB5 of the second page are set to 260° C., and the target temperatures of the heating bocks HB1, 2, 6 and 7 of the second page are set to 250° C. (S2601).

Then while the second page is held and conveyed in the fixing nip portion N (time t=t5), the engine controller 113 additionally receives the image information on the fourth page. At this time, in the flow in FIG. 16, processing advances in the order of S1611, S1603, S1612 and S1601. Since the specified Maxink values of the fourth page are 120% in the control blocks HB3 to HB5, the correction temperatures of the heat generating blocks HB3 to HB5 of the fourth page are set to −10° C., and the corrected tentative target temperatures of the heat generating blocks HB3 to HB5 of the fourth page are set to 260° C. Since the specified Maxink values of the heat generating blocks HB1, 2, 6 and 7 are 0%, the correction temperatures of the heat generating blocks HB1, 2, 6 and 7 of the fourth page are set to −20° C., and the corrected tentative target temperatures of the heat generating blocks HB1, 2, 6 and 7 of the fourth page are set to 250° C.

Since the target temperature of the current page (second page) is the maximum value of the tentative target temperatures of the second to fourth pages, the target temperatures of the heat generating blocks HB3 to HB5 of the current page are set to 260° C., and the target temperatures of the heat generating blocks HB1, 2, 6 and 7 of the current page are set to 250° C.

The heat generating member control unit 507 controls the temperatures of the heat generating blocks HB1 to HB7 in accordance with the target temperatures that are set.

Control Flow Chart of Pre-Rotation Sequence in Comparative Example 4

As Comparative Example 4, a case of performing printing in a state of not storing the most recent 200 pages of operation history in the operation history collection unit 506 will be described. In Comparative Example 4, the operation in the pre-heating sequence is the same as Comparative Example 1.

Figure 23:
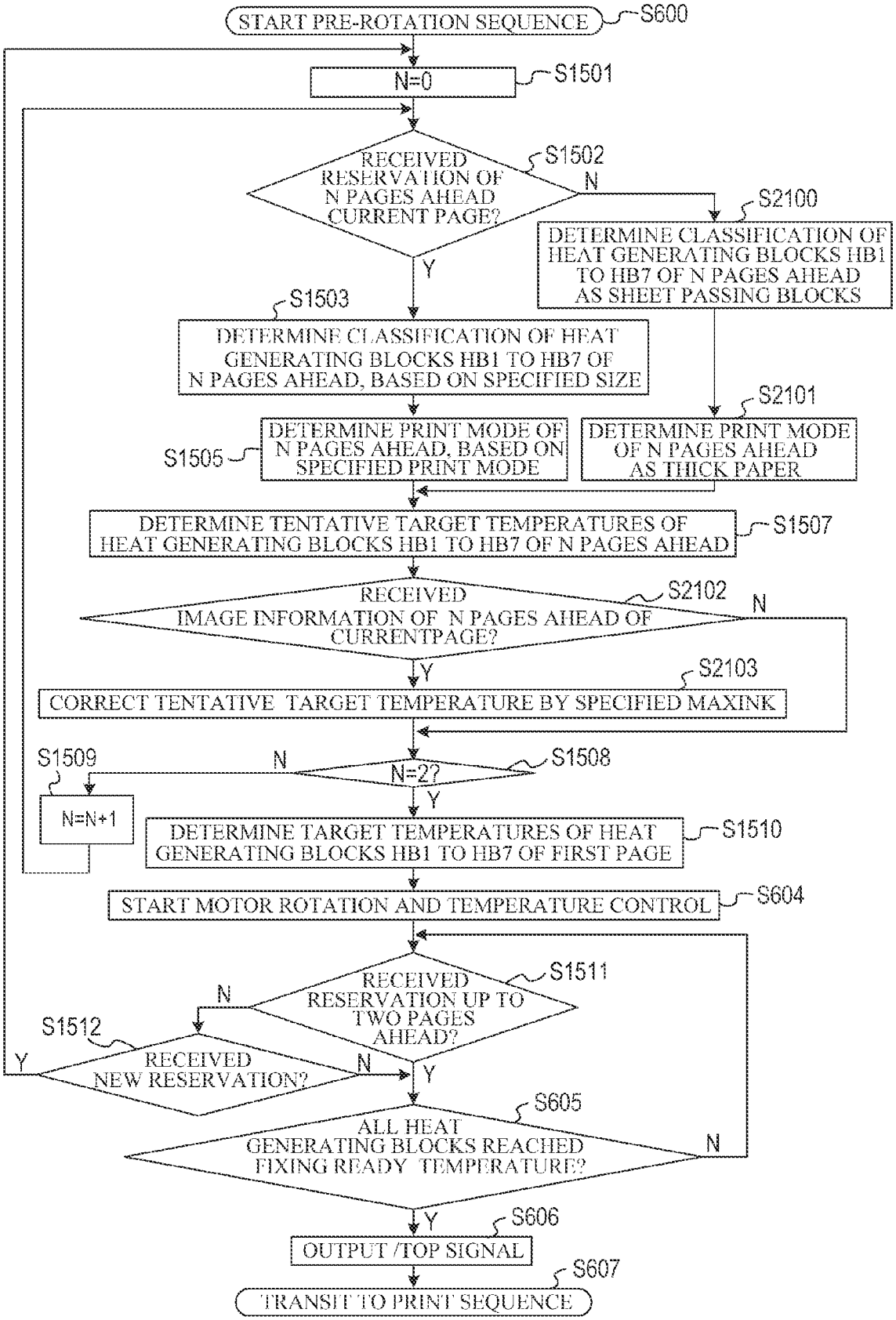
FIG. 23 is a control flow chart of a pre-rotation sequence according to Comparative Example 4.

FIG. 23 is a control flow chart of the pre-rotation sequence of Comparative Example 4.

S600, S1501 to S1503, S1505, S2100, S2101 and S1507 are the same as Embodiment 4 (FIG. 21).

If the specified Maxink values of the recording material that is N pages ahead were not sent in S2102, processing advances to S1508. S2103, S1508 to S1512 and S604 to S607 are the same as Embodiment 4 (FIG. 21).

Flow Chart of Print Sequence in Comparative Example 4

The control flow chart of the print sequence in Comparative Example 4 will be described with reference to FIG. 16. Processing steps other than S1601 are the same as FIG. 16 (Embodiment 3), therefore description thereof will be omitted.

In S1601, the target temperatures for three pages, including the current page, are set in the same procedure as S1501 to S1503, S1505, S2100 to S2103 and S1507 to S1510 described in FIG. 23.

Transition Example of Heating Generating Block Temperature in Comparative Example 4

A transition example of the heat generating block temperatures, in the case of performing printing in Comparative Example 4, will be described.

Figure 24:
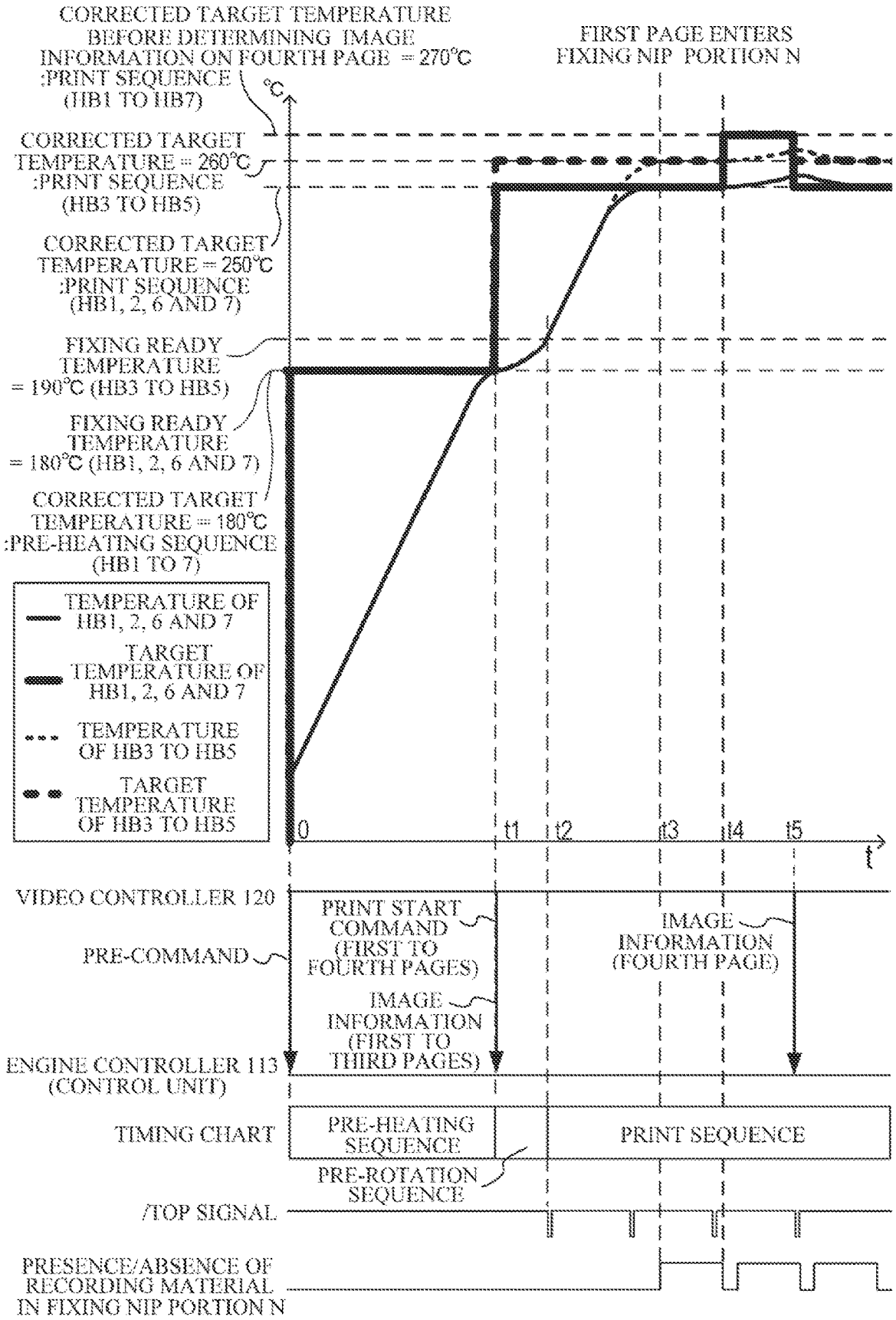
FIG. 24 is a diagram depicting a temperature transition of heat generating blocks HB1 to HB7 according to Comparative Example 4.

FIG. 24 indicates a heat generating block temperature transition in the case of continuously printing four pages of letter size plain paper according to Comparative Example 4, where the engine controller 113 additionally receives the image information on the fourth page while the image heating operation is performed on the second page of the recording material.

At time t=0, the video controller 120 sends the pre-command to the engine controller 113.

Hereafter the pre-heating sequence is performed in the same manner as Comparative Example 1, and based on S800, the target temperatures of the heat generating blocks HB1 to HB7 in the pre-heating sequence are set to the target temperature 180° C. of the sheet passing block in the pre-heating sequence for thick paper.

Then at time t=t1, the video controller 120 instructs the engine controller 113 the print reserve information on the first to fourth pages, the print start command and image information on the first to third pages. Then after the heat generating blocks HB1 to HB7 reach the image forming target temperatures, the recording material, on which the toner image is formed is laid, enters the fixing nip portion N (t=t3), and is held and conveyed, whereby the unfixed toner image is fixed.

Then at time t=t4, the image forming control unit 502 instructs the temperature control unit 505 to perform temperature control for the second page of the recording material. Just like Embodiment 4, the tentative target temperatures of the heat generating blocks HB1 to HB7 are set to 270° C. respectively.

At the point of t=t4, the image information on the fourth page (specified Maxink values) is not yet sent (N in S2102). Therefore the correction of the target temperatures using the image information is not yet performed for the fourth page, and the S2103 is skipped, then the corrected tentative target temperatures of the heat generating blocks HB1 to HB7 of the fourth page are set to 270° C.

Since the target temperature of the current page (second page) is the maximum value of the corrected tentative target temperatures of the second to fourth pages, the target temperatures of the heat generating blocks HB1 to HB7 of the second page are set to 270° C. (S1601).

Then while the second page is held and conveyed in the fixing nip portion N (time t=t5), the engine controller 113 additionally receives the image information on the fourth page. As a result, according to the same flow as Embodiment 4, the corrected tentative target temperatures of the heat generating blocks HB1, 2, 6 and 7 of the fourth page are set to 250° C. (S2103).

Since the target temperature of the current page (second page) is the maximum value of the tentative target temperatures of the second to fourth pages, the target temperatures of the heat generating blocks HB3 to HB5 of the current page are set to 260° C., and the target temperatures of the heat generating blocks HB1, 2, 6 and 7 of the current page are set to 250° C.

The heat generating member control unit 507 controls the temperatures of the heat generating blocks HB1 to HB7 in accordance with the target temperatures that are set.

Transition Example When Estimated Maxink and Specified Maxink are Different in Embodiment 4

A case where the image information analysis result (estimated Maxink values) and the image information on the fourth page (specified Maxink values) are different in Embodiment 4 will be described. In this case, output of the/TOP signal of the fourth page is delayed by the delay time Δt2 in S1610, so that the heat generating blocks HB1 to HB7 reach the target temperatures before the fourth page of the recording material enters the fixing nip portion N.

Figure 25:
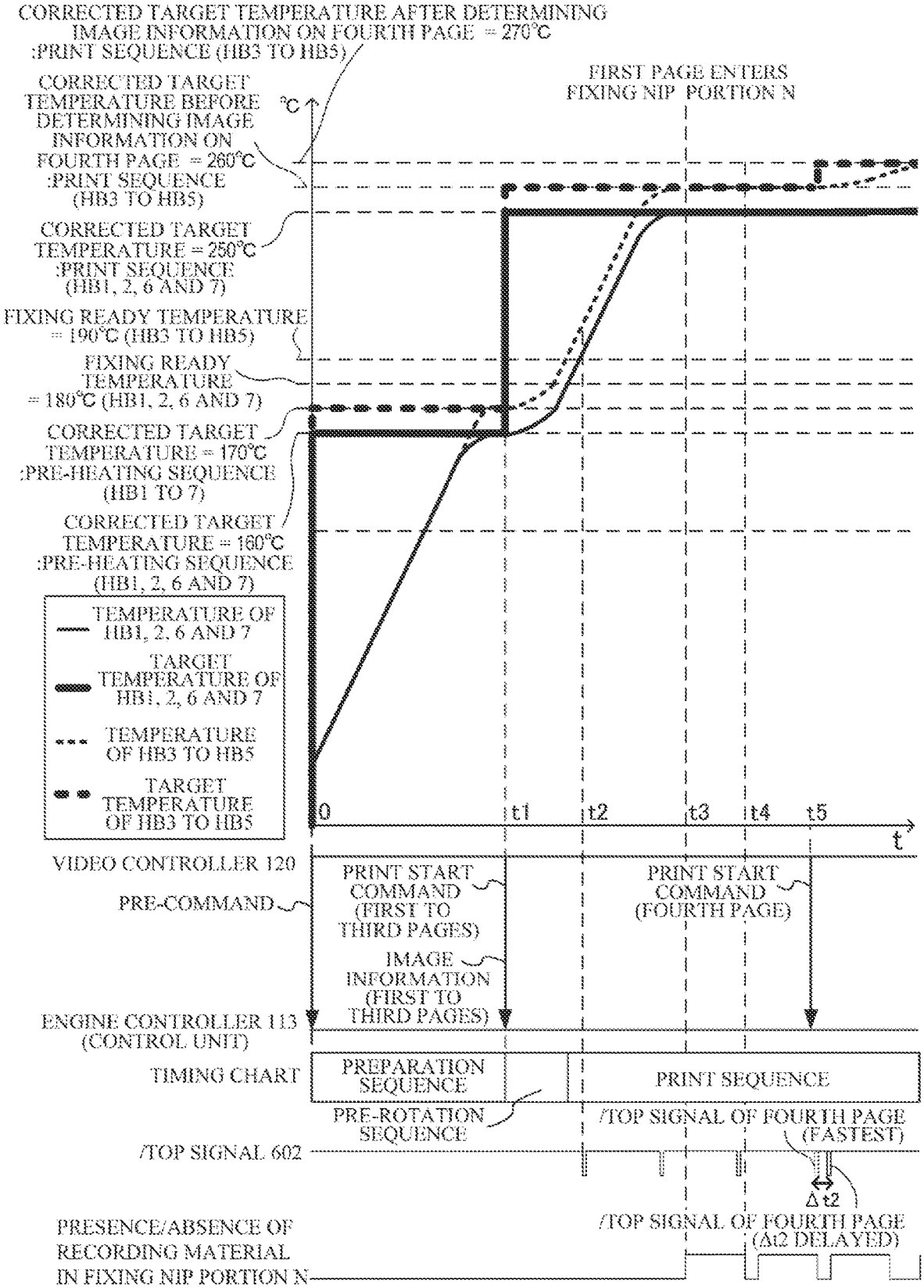
FIG. 25 is a diagram depicting a temperature transition in the case where an estimated Maxink and a specified Maxink are different according to Embodiment 4.

FIG. 25 is an example when the estimated Maxink values and the specified Maxink values of the fourth page are different. FIG. 25 indicates the heat generating block temperature transition in the case of continuously printing four pages of letter size plain paper, where the engine controller 113 additionally receives the image information on the fourth page while the image heating operation is performed on the second page of the recording material. The image information is the same for the first to third pages, and the Maxink values of the heat generating blocks HB3 to HB5 are 120%, and the Maxink values of the heat generating blocks HB1, 2, 6 and 7 are 0%. In the case of the image information on the fourth page, the Maxink values of the heat generating blocks HB3 to HB5 are 230%, and the Maxink values of the heat generating blocks HB1, 2, 6 and 7 are 0%.

The image information analysis result is the same as FIG. 22. The operation in the period from the pre-command to receiving the image information on the fourth page is the same as FIG. 22, but the operation thereafter is different from FIG. 22.

While the second page is held and conveyed in the fixing nip portion N (time t=t5), image information on the fourth page is received. The specified Maxink values of the heat generating blocks HB3 to HB5 of the fourth page are 230%, hence the correction temperatures of the heat generating blocks HB3 to HB5 of the fourth page are set to −0° C., and the corrected tentative target temperatures of the heat generating blocks HB3 to HB5 of the fourth page are set to 270° C. The specified Maxink values of the heat generating blocks HB1, 2, 6 and 7 of the fourth page are 0%, hence the correction temperatures of the heat generating blocks HB1, 2, 6 and 7 of the fourth page are set to −20° C., and the corrected tentative target temperatures of the heat generating blocks HB1, 2, 6 and 7 of the fourth page are set to 250° C.

Since the target temperature of the current page (second page) is the maximum value of the tentative target temperatures of the second to fourth pages, the target temperatures of the heat generating blocks HB3 to HB5 of the current page are set to 270° C., and the target temperatures of the heat generating blocks HB1, 2, 6 and 7 of the current page are set to 250° C.

The engine controller 113 delays the output of the/TOP signal of the fourth page by the delay time Δt2 (=0.3 seconds) calculated using Expression 5 compared with the case of the fastest output.

Effect

In Embodiment 4, in the period when the second page is passing the recording material fixing nip portion N, the target temperatures of the heat generating blocks HB3 to HB5, before receiving the image information on the fourth page, are set to 260° C., which is lower than the target temperature 270° C. in Comparative Example 4 by 10° C. Further, the target temperatures of the heat generating blocks HB1, 2, 6 and 7 are set to 250° C., which is lower than the target temperature 270° C. in Comparative Example 4 by 20° C. Since the target temperature setting is decreased, the power required to reach and maintain the target temperature can be reduced accordingly.

As described above, according to Embodiment 4, in the case where the image information on the succeeding sheet is not determined, the Maxink values of the succeeding sheet are estimated based on the image information analysis result. Compared with the case of estimating that the Maxink values of the succeeding sheet are the maximum value (Comparative Example 4), the heating amount of the sheet passing block in the print sequence can be decreased. Thereby to the user who repeatedly performs printing in accordance with a specific layout, an image forming apparatus that can reduce power consumption with implementing high image quality can be provided.

Modification

The image information handled in Embodiment 4 is the Maxink values, but image information is not limited to this. For example, the correction temperatures may be determined depending on whether the image is constituted of text alone. The correction temperature may be set to −10° C. if the image is constituted of text alone, or to 0° C. if not. Further, instead of the maximum value of the toner amount conversion value, an average value (Averageink) or the like may be used. Further, the correction temperatures of the target temperatures based on the Maxink are set as indicated in Table 7, but the correction temperatures are not limited to these temperatures. In Embodiment 4, the number of pages stored in the operation history collection unit 506 is not limited to 200, but may be an any number. Further, in the frequency distribution of the number of printed pages with Maxink values, the temperature control unit 505 accumulates the number of printed pages in sequence from the lower Maxink value, and determines the range of the Maxink values when the accumulated number of printed pages exceeds 160 pages, that is, the ratio 80% of the total in S801, but this ratio is not limited to 80%.

Further, in Embodiment 4, for the fourth page, the letter size plain paper is printed, where the Maxink values of the heat generating blocks HB3 to HB5 are 120%, and the Maxink values of the heat generating blocks HB1, 2, 6 and 7 are 0%, but an arbitrary size and image information may be used. The additionally printed page is not limited to the fourth page, but may be an arbitrary page.

Further, in Embodiment 4, if 200 pages of operation history with Maxink value are not stored, the target temperatures are not corrected using the estimated Maxink values, but the embodiments of the present invention are not limited to this, and the estimated Maxink values may be predetermined values. For example, if the estimated Maxink value is 0%, the target temperatures of the heat generating blocks HB1 to HB7 can be set to 250° C., and the power consumption can be further decreased. If the image density is then determined and the specified Maxink values of the heat generating blocks HB1 to HB7 are different from the estimation, the conveying interval between the preceding recording material and the succeeding recording material is increased (extended), just like Embodiment 4.

OTHER EMBODIMENTS

In Embodiments 1 to 4, a case of handling both the print reserve information analysis result and the image information analysis result was not described, but a reduction of power consumption of the image forming apparatus, which is the object of the present invention, can also be implemented by combining the print reserve information analysis result and the image information analysis result. For example, Embodiments 1 and 2 may be combined, or Embodiments 3 and 4 may be combined. In other words, a configuration of each of the above embodiments may be combined as much as possible.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-139601, filed on Jul. 30, 2019, which is hereby incorporated by reference herein in its entirety.

What is claimed is:

1. An image forming apparatus, comprising:

an image forming portion configured to form a toner image on a recording material based on image data;

a fixing portion configured to fix the toner image formed on the recording material to the recording material, the fixing portion including a heater having a plurality of heat generating blocks arranged in a direction perpendicular to a conveying direction of the recording material;

a control portion controls the image forming portion and the fixing portion; and a storage portion configured to store operation history information corresponding to an operation of the fixing portion, wherein the control portion independently controls the plurality of heat generating blocks, and wherein the control portion sets target temperatures of each of the plurality of the heat generating blocks based on the operation history information before a type of the recording material on which the toner image is formed or content of the image data of the toner image to be formed on the recording material is determined.

2. An image forming apparatus according to claim 1, wherein the fixing portion includes a cylindrical film and a roller contacting an outer surface of the film, wherein the heater is provided in an inner space of the film, and wherein the recording material is conveyed at a nip portion formed by the heater and the roller through the film.

* * * * *